US008783160B2

(12) United States Patent
Hochstrate et al.

(10) Patent No.: US 8,783,160 B2
(45) **Date of Patent: *Jul. 22, 2014**

(54) FIREARM WITH GAS OPERATING SYSTEM

(71) Applicant: Colt Defense LLC, West Hartford, CT (US)

(72) Inventors: Paul Hochstrate, Plantsville, CT (US); Laurance Robbins, Plantsville, CT (US); Arthur F. Daigle, Plymouth, CT (US)

(73) Assignee: Colt's Manufacturing Company LLC, West Hartford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/964,664

(22) Filed: Aug. 12, 2013

(65) Prior Publication Data

US 2014/0076152 A1 Mar. 20, 2014

Related U.S. Application Data

(60) Continuation of application No. 13/398,976, filed on Feb. 17, 2012, now Pat. No. 8,505,433, which is a continuation of application No. 13/103,663, filed on May 9, 2011, now Pat. No. 8,117,958, which is a continuation of application No. 12/857,189, filed on Aug. 16, 2010, now Pat. No. 7,938,055, which is a division of application No. 11/672,189, filed on Feb. 7, 2007, now Pat. No. 7,775,150.

(60) Provisional application No. 60/722,494, filed on Feb. 9, 2006.

(51) Int. Cl.

| | |
|---|---|
| ***F41A 5/20*** | (2006.01) |
| ***F41A 5/26*** | (2006.01) |
| ***F41A 5/18*** | (2006.01) |
| ***F41C 23/16*** | (2006.01) |

(52) U.S. Cl.

CPC ... *F41A 5/26* (2013.01); *F41A 5/18* (2013.01); *F41C 23/16* (2013.01)

USPC ..... 89/193; 89/191.01; 89/191.02; 89/192; 42/71.01; 42/72; 42/75.01

(58) Field of Classification Search

CPC ..... F41A 5/26; F41A 5/18; F41A 11/00; F41C 23/16

USPC ..... 89/191.01–194, 4.2, 4.5; 42/71.01, 72, 42/75.01, 85, 127

See application file for complete search history.

(56) References Cited

U.S. PATENT DOCUMENTS

| | | | |
|---|---|---|---|
| 3,246,567 | A | 4/1966 | Miller |
| 3,611,607 | A | 10/1971 | Donnell |

(Continued)

FOREIGN PATENT DOCUMENTS

| | | |
|---|---|---|
| DE | 19702962 | 7/1998 |
| WO | 2006138106 A2 | 12/2006 |

(Continued)

OTHER PUBLICATIONS

European Search Report for Application No. 07866991.8-1260 dated Oct. 19, 2012.

(Continued)

*Primary Examiner* — Michael David

(74) *Attorney, Agent, or Firm* — Cantor Colburn LLP

(57) ABSTRACT

An indirect gas operating system for a semi-automatic or automatic rifle is provided, the indirect gas operating system having: a gas block secured to the rifle; a barrel secured to the rifle; a bolt carrier slidably received within a receiver of the rifle; a means for moving the bolt carrier within the receiver using gases discharged into a bore of the barrel of the rifle, wherein the means for moving is removably secured to the gas block such that the means for moving can be removed from the rifle through a forward end of the gas block without removing the gas block from the rifle; and an externally threaded barrel nut for securing the barrel to the receiver.

19 Claims, 34 Drawing Sheets

(56) References Cited

U.S. PATENT DOCUMENTS

| | | | |
|---|---|---|---|
| 4,244,273 | A | 1/1981 | Langendorfer, Jr. et al. |
| 4,433,610 | A | 2/1984 | Tatro |
| 4,433,611 | A | 2/1984 | Baumann |
| 4,658,702 | A | 4/1987 | Tatro |
| 4,845,871 | A | 7/1989 | Swan |
| 5,272,956 | A | 12/1993 | Hudson |
| 5,726,377 | A | 3/1998 | Harris et al. |
| 5,760,328 | A | 6/1998 | Robbins |
| 5,824,943 | A | 10/1998 | Guhring et al. |
| 5,900,577 | A | 5/1999 | Robinson et al. |
| 5,945,626 | A | 8/1999 | Robbins |
| 6,250,194 | B1 | 6/2001 | Brandl et al. |
| 6,314,672 | B2 | 11/2001 | Murello et al. |
| 6,609,321 | B2 | 8/2003 | Faifer |
| 6,775,942 | B2 | 8/2004 | Compton |
| 6,779,288 | B1 | 8/2004 | Kim |
| 6,792,711 | B2 | 9/2004 | Battaglia |
| 6,848,351 | B1 | 2/2005 | Davies |
| 6,854,206 | B2 | 2/2005 | Oz |
| 6,895,708 | B2 | 5/2005 | Kim et al. |
| 7,059,076 | B2 | 6/2006 | Stoner et al. |
| 7,131,228 | B2 | 11/2006 | Hochstrate et al. |
| 7,137,217 | B2 | 11/2006 | Olson et al. |
| RE39,465 | E | 1/2007 | Swan |
| 7,204,052 | B2 | 4/2007 | Swan |
| 7,213,498 | B1 | 5/2007 | Davies |
| 7,313,883 | B2 | 1/2008 | Leitner-Wise |
| RE40,216 | E | 4/2008 | Swan |
| 7,363,741 | B2 | 4/2008 | DeSomma et al. |
| 7,418,898 | B1 | 9/2008 | Desomma |
| 7,461,581 | B2 | 12/2008 | Leitner-Wise |
| 7,469,624 | B1 | 12/2008 | Adams |
| 7,523,580 | B1 | 4/2009 | Tankersley |
| 7,574,823 | B2 | 8/2009 | Nakayama |
| 7,584,567 | B1 | 9/2009 | DeSomma et al. |
| 7,596,900 | B2 | 10/2009 | Robinson et al. |
| 7,610,844 | B2 | 11/2009 | Kuczynko et al. |
| 7,637,199 | B2 | 12/2009 | Fluhr et al. |
| 7,685,758 | B2 | 3/2010 | Romer |
| 7,739,939 | B2 | 6/2010 | Adams |
| 7,752,797 | B1 | 7/2010 | Swan |
| 7,775,150 | B2 | 8/2010 | Hochstrate et al. |
| 7,779,743 | B2 | 8/2010 | Herring |
| 7,810,271 | B2 | 10/2010 | Patel |
| 7,938,055 | B2 | 5/2011 | Hochstrate et al. |
| 7,971,518 | B2 | 7/2011 | Adams |
| 8,117,958 | B2 | 2/2012 | Hochstrate et al. |
| 2003/0126781 | A1 | 7/2003 | Herring |
| 2005/0011104 | A1 | 1/2005 | Oz |
| 2005/0115398 | A1 | 6/2005 | Olson |
| 2005/0262752 | A1 | 12/2005 | Robinson et al. |
| 2006/0026883 | A1 | 2/2006 | Hochstrate et al. |
| 2006/0053673 | A1 | 3/2006 | Murello |
| 2006/0065112 | A1 | 3/2006 | Kuczynko et al. |
| 2006/0236582 | A1 | 10/2006 | Lewis et al. |
| 2006/0260169 | A1 | 11/2006 | Samson et al. |
| 2007/0033851 | A1 | 2/2007 | Hochstrate et al. |
| 2007/0199435 | A1 | 8/2007 | Hochstrate et al. |
| 2009/0000173 | A1 | 1/2009 | Robinson et al. |
| 2009/0007477 | A1 | 1/2009 | Robinson et al. |
| 2009/0031605 | A1 | 2/2009 | Robinson |
| 2009/0031606 | A1 | 2/2009 | Robinson et al. |
| 2009/0031607 | A1 | 2/2009 | Robinson et al. |
| 2009/0038198 | A1 | 2/2009 | Yu |
| 2009/0077855 | A1 | 3/2009 | Pritchett |
| 2010/0000400 | A1 | 1/2010 | Brown |
| 2010/0101405 | A1 | 4/2010 | Adams |
| 2010/0186582 | A1 | 7/2010 | Juarez |
| 2010/0199836 | A1 | 8/2010 | Herring |
| 2010/0218671 | A1 | 9/2010 | Mayberry et al. |
| 2010/0269682 | A1 | 10/2010 | Vuksanovich et al. |
| 2011/0303082 | A1 | 12/2011 | Hochstrate et al. |
| 2012/0152104 | A1 | 6/2012 | Audibert et al. |

FOREIGN PATENT DOCUMENTS

| | | | |
|---|---|---|---|
| WO | 2007014770 | | 2/2007 |
| WO | 2008060310 | A2 | 5/2008 |
| WO | 2008140833 | | 11/2008 |
| WO | 2010111026 | | 9/2010 |
| WO | 2010111109 | | 9/2010 |

OTHER PUBLICATIONS

European Search Report for Application No. 08164507.9-1260 dated Jan. 25, 2013.

European Search Report for Application No. 07866991.8-1260 dated Oct. 26, 2011.

Remington Defense, RGP Brochure.

Para Ordnance 2010 Catalog.

ZM Weapons Safety and Instructions Manual, http://www.ar15.com/content/manuals/lr300.pdf.

Monkey Wrench, A Closer Look at the MGI QCB-D Upper Receiver, http://referenceonly.wordpress.com/2010/10/09a-closer-look-at-the-mgi-qcb-d-upper-receiver/.

NRA Staff, American Rifleman, Para USA Tactical Target Rifle, http://www.americanrifleman.org/ArticlePage.aspx?id=2070&cid=4.

Mega Arms, Monolithic Tactical System, http://megamachineshop.com/pdf/MTS-ASSEMBLY-INSTRUCTIONS.

Para Ordance, Tactical Target Rifle Specifications, http://www.paraord.com/new/product_rifle.php#specs.

Smith & Wesson, M&P 15 Rifle Manual, http://www.smith-wesson.com/wcsstore/SmWesso2/upload/other/S&W_M&P_Rifle_Manual.pdf.

Barret, REC-7 Manual, http://www/net/pdfs/Manual-REC7.pdf.

Bushmaster Firearms, Bushmaster Owner's Manual, http://www.bushmaster.com/electronic-documents/ACR-owners-manual.pdf.

FIREARM WITH GAS OPERATING SYSTEM

CROSS-REFERENCE TO RELATED APPLICATION(S)

This application is a continuation of U.S. patent application Ser. No. 13/398,976 filed Feb. 17, 2012, which is a continuation of U.S. patent application Ser. No. 13/103,663 filed May 9, 2011, now U.S. Pat. No. 8,117,958, which is continuation of U.S. patent application Ser. No. 12/857,189 filed Aug. 16, 2010, now U.S. Pat. No. 7,938,055, which is a divisional of U.S. patent application Ser. No. 11/672,189 filed Feb. 7, 2007, now U.S. Pat. No. 7,775,150 which claims benefit of U.S. Provisional Patent application Ser. No. 60/772,494 filed Feb. 9, 2006, the contents each of which are incorporated herein by reference thereto.

BACKGROUND

The disclosed embodiments relate to an improved rifle and its law enforcement and commercial variances and, more particularly, to an improved military rifle having modular subassemblies.

There are conventional firearms with an integral upper receiver and hand guard. The conventional firearms have a removable hand guard section fastened to the hand guard on the upper receiver with screws or other similar fasteners. Field removal/reinstallation of the conventional hand guard section hence involves removal/installation tools (for example screw drivers), and once removed the mounting screws may be lost. This is not desirable in operational conditions. Further, conventional firearms with an upper receiver having an integral hand guard, may encumber field removal and replacement of the barrel. By way of example, in a conventional military rifle, for example an "M-4"™ type firearm having an upper receiver with integral hand guard, the barrel nut (fastening the barrel to the receiver) may be covered or "buried" within the hand guard thereby limiting accessibility to the barrel nut. Moreover, conventional barrel nuts may have features such as peripheral clearance slots, for the gas tube or operating rod of an indirect gas operating system, that further impair accessibility to surface or features of the barrel nut engaged in order to apply tightening or untightening torque to the barrel nut. As may be realized, rotation of the conventional barrel nut, such as at removal/replacement of the barrel, may involve additional undesired disassembly of the firearm systems. By way of example, the gas tube, or operating rod of an indirect gas operating system may have to be removed from the firearm in order to allow rotation of the barrel nut for nut removal. In other words, the operating rod or gas tube may have to be removed prior to barrel removal. Similarly, on reinstallation, the barrel and at least the operating rod of the firearm indirect gas operating system, or the gas tube may have to be assembled/connected to the receiver in sequence, rather than in unison, in order to allow rotation of the barrel nut. This is not desired. Further still, the interface between the barrel, receiver and barrel nut in conventional firearms may result in the barrel being eccentrically positioned in an uncontrolled manner relative to the mating bore of the receiver. This also is undesired. The exemplary embodiments disclosed herein overcome the problems conventional firearms as will be described further below.

SUMMARY OF THE EMBODIMENTS

In accordance with one exemplary embodiment, an indirect gas operating system for an automatic or semi-automatic firearm is provided.

In accordance with another exemplary embodiment, an indirect gas operating system for a semi-automatic or automatic rifle is provided. The indirect gas operating system having: a gas block secured to the rifle; a barrel secured to the rifle; a bolt carrier slidably received within a receiver of the rifle; a means for moving the bolt carrier within the receiver using gases discharged into a bore of the barrel of the rifle, wherein the means for moving is removably secured to the gas block such that the means for moving can be removed from the rifle through a forward end of the gas block without removing the gas block from the rifle; and an externally threaded barrel nut for securing the barrel to the receiver.

In accordance with yet another exemplary embodiment, a semi-automatic or automatic rifle is provided. The rifle having: a gas block fluid coupled to a bore of a barrel of the rifle; a bolt carrier slidably received within a receiver of the rifle; a sleeve removably secured to a forward end of a gas block of the rifle; a piston slidably received within the gas block, wherein the gas block and the sleeve fluidly couple the piston to the bore of the rifle; wherein an increase in pressure in the bore of the rifle causes the piston to move away from the sleeve; wherein the sleeve and the piston are each capable of being removed from the rifle through the forward end of the gas block; and wherein the receiver has an integral hand guard portion and a removable hand guard portion and wherein the removable hand guard portion when removed from the receiver provides access to a barrel nut that secures the barrel to the receiver.

In still yet another exemplary embodiment, a method of fluidly coupling a barrel of a semi-automatic or automatic rifle to a bolt carrier of the rifle is provided. The method including the steps of: providing a means for moving a bolt carrier within a receiver of the rifle using gases discharged into a bore of a barrel of the rifle, wherein the means for moving is removably secured to a gas block of the rifle such that the means for moving can be removed from the rifle through a forward end of the gas block without removing the gas block from the rifle; and removably securing a removable hand guard portion to an integral hand guard portion of the receiver of the rifle, wherein the removable hand guard when removed provides access to a barrel nut that secures the barrel to the rifle.

BRIEF DESCRIPTION OF THE DRAWINGS

The foregoing aspects and other features of the exemplary embodiments are explained in the following description, taken in connection with the accompanying drawings, wherein.

DETAILED DESCRIPTION OF THE EXEMPLARY EMBODIMENT(S)

Figure 1:
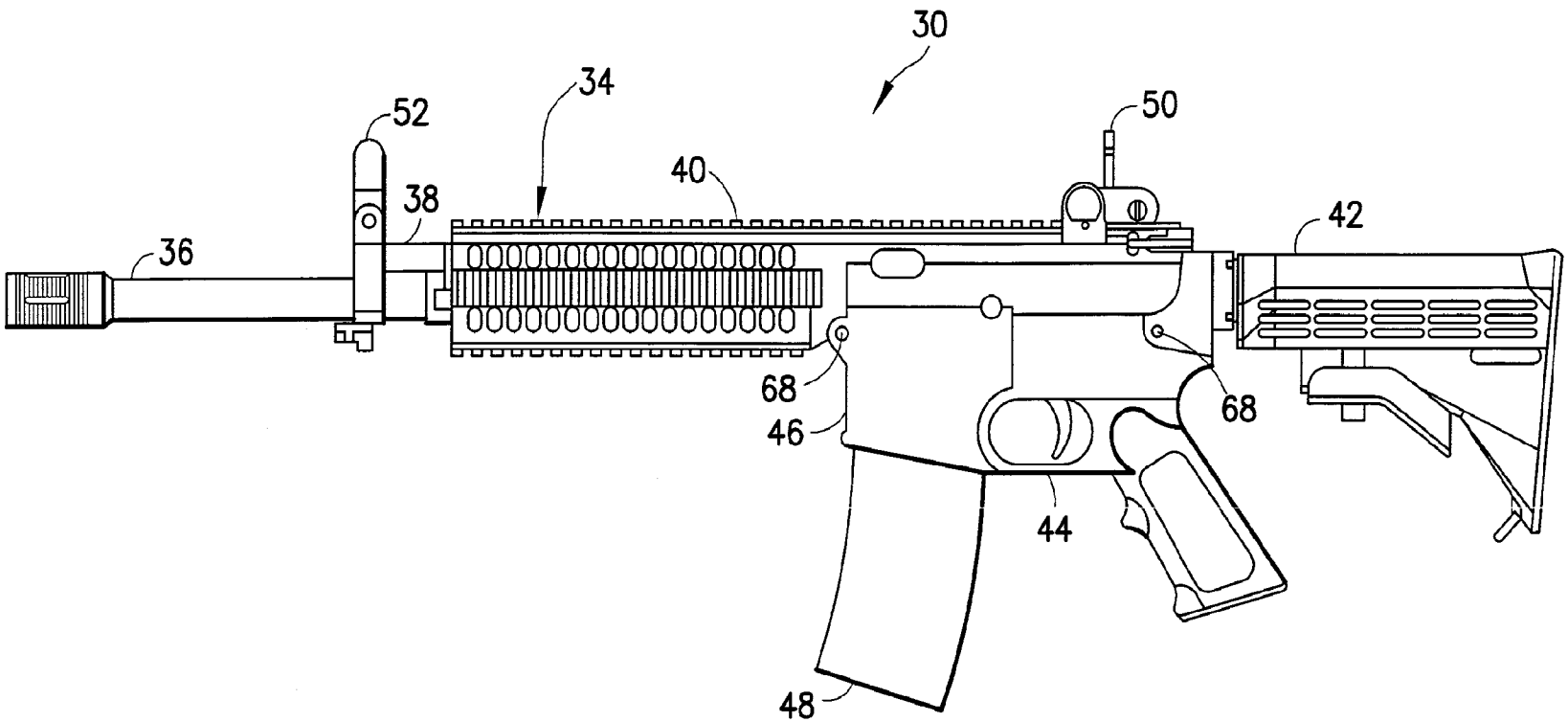
FIG. 1 is a side elevation view of an automatic firearm incorporating features in accordance with an exemplary embodiment.

Referring to FIG. 1, there is shown, a side elevation view of an automatic firearm 30 capable of automatic or semiautomatic fire incorporating features in accordance with an exemplary embodiment of the present invention. Although the present invention will be described with reference to the embodiments shown in the drawings, it should be understood that the present invention can be embodied in many alternate forms of embodiments. In addition, any suitable size, shape or type of elements or materials could be used.

Firearm 30 may be gas operated, like examples, such as the M-4 or M-16 type or similar commercial variants thereof. Firearm 30 may have operational features such as disclosed in U.S. Pat. Nos. 5,726,377, 5,760,328, 4,658,702, 4,433,610, U.S. Non Provisional patent application Ser. No. 10/836,443 filed Apr. 30, 2004, U.S. Provisional Patent Application 60/564,895 filed Apr. 23, 2004, and U.S. patent application Ser. No. 11/352,036 filed Feb. 9, 2006, all of which are hereby incorporated by reference herein in their entirety. The firearm 30 and its sections described in greater detail below is merely exemplary. In alternate embodiments the firearm 30 may have other sections, portions or systems. Firearm 30 may have an upper receiver section 34 a barrel 36, gas piston system 38, and hand guard 40. In the embodiment shown, rifle 30 has receiver 34 having an integral hand guard portion with barrel 36 removably connected to receiver 34. Here, the hand guard portion extends over and surrounds barrel 36. As will be described below, a removable accessory device mounting rail is removably connected to the receiver and has another hand guard portion mateable with the integral hand guard portion of the receiver as shown here in a locked position, locked to the receiver having an integral hand guard. When in the unlocked position, the mounting rail is unlocked and freely movable relative to the receiver. In alternate embodiments, the firearm may have an indirect gas operating system or gas tube operating system. Further, in alternate embodiments, the firearm may have neither a piston or gas operating system and may rely on recoil action to cycle the weapon, for example, in semi-automatic mode. Here, the gas operated linkage actuating the bolt carriage in the upper receiver may be replaced by a gas tube. Firearm 30 may incorporate stock 42, lower receiver section 44, magazine well 46, clip or magazine 48 and rear and front sights 50, 52. As will be described below, upper receiver 34 having barrel 36, lower receiver 44 and magazine well 46 are modular and configurable such that firearm 30 comprises a modular rifle design. In addition, lower receiver 44 and magazine well 46 may be removable without tools or fasteners. In alternate embodiments, more or less modules and assemblies may be removable without tools or fasteners. As an example, magazine well 46 may be replaceable and removable such that magazine well 46 may be replaced with a different magazine well to change caliber. Additionally, modularity with interlocking components is provided for ease of assembly and disassembly without affecting fire accuracy as well as to provide a single configurable firearm without having to support multiple firearms. Further, the hand guard, and accessory mounting rails thereon, may be integral with the upper receiver and the integral upper receiver, hand guard and mounting rails may be of unitary construction.

Figure 2:
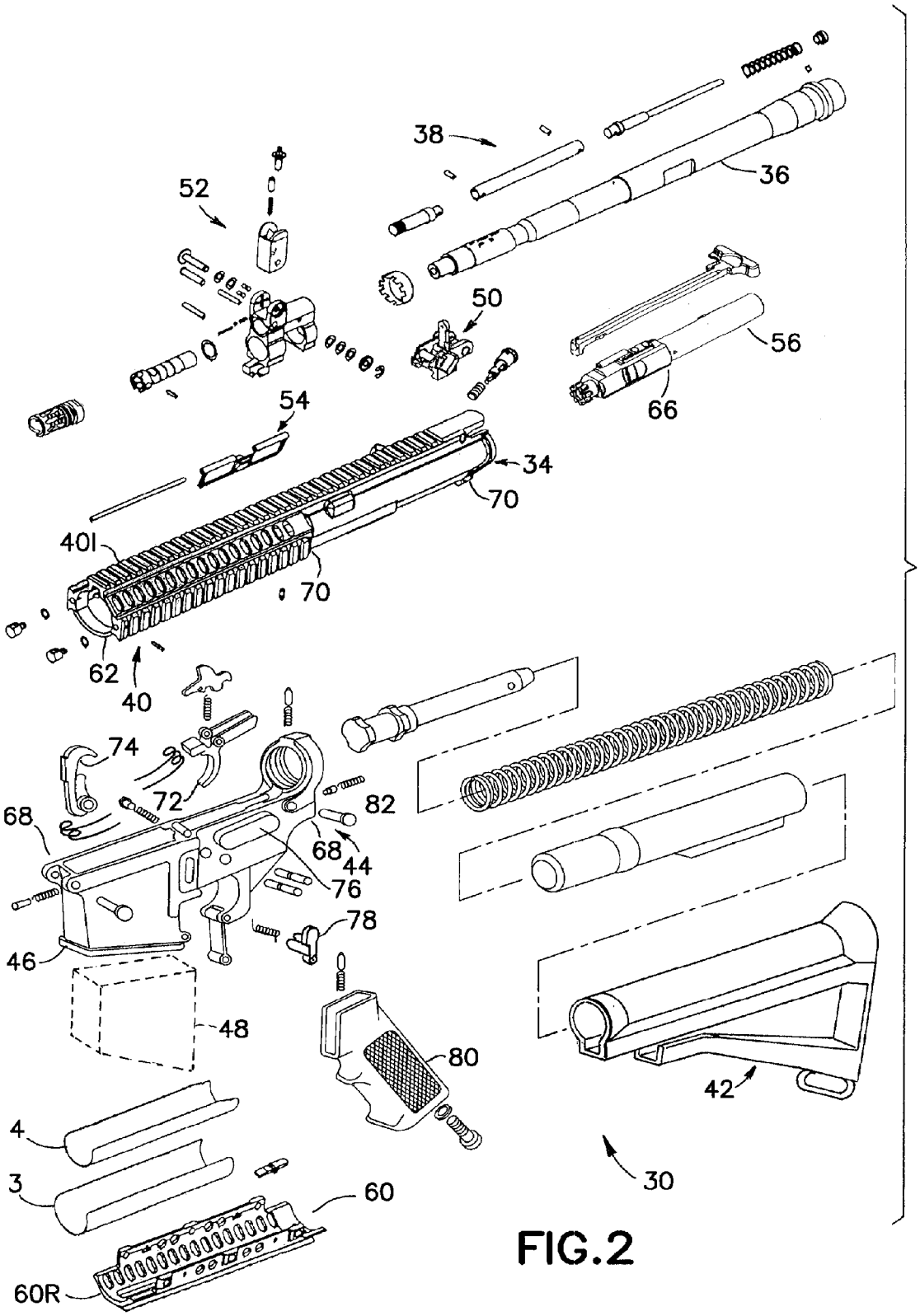
FIG. 2 is an exploded isometric view of the automatic firearm including an exploded isometric view of the upper receiver with hand guard section shown in FIG. 1.

Referring now to FIG. 2, there is shown an exploded isometric view of the automatic firearm including an exploded isometric view of the upper receiver with hand guard section shown in FIG. 1. As noted before, firearm 30 generally incorporates an upper receiver section 34, barrel 36, gas piston system 38, hand guard 40, rear and front sights 50, 52, ejection port cover attachment 54 and bolt assembly 56. Firearm 30 may incorporate stock 42, lower receiver section 44, magazine well 46, clip or magazine 48 and auto sear actuator 66 assembled to the bolt carrier (not shown). The barrel 36 and/or the bolt/bolt carrier 56 may be coupled to upper receiver section using conventional splined and/or threaded/pinned locking techniques or otherwise. Hand guard 40 may have features such as disclosed in U.S. Pat. Nos. 4,663,875 and 4,536,982, both of which are hereby incorporated by reference herein in their entirety. Hand guard 40 has features for mounting additional devices on one or more rails as shown and may be configured with such rails as a "Piccatiny Rail" configuration as described in Military Standard 1913, which is hereby incorporated by reference herein in its entirety. The hand guard and rails may be made from any suitable material such as hard coat anodized aluminum as an example. Hand guard 40 may be configured for basic mission profiles or light duty rail requirements while simplifying techniques such as the Gun/Light technique with firearms such as the M-4. The peripheral devices may be devices such as sights, illumination devices, vision enhancing devices, launchers, laser aiming devices, Global Positioning or aiming devices or otherwise. In alternate embodiments, more or less similar or different devices may be provided and more or less rail(s) may be provided. In the exemplary embodiment shown in FIG. 2, upper receiver 34 may be of one-piece, or unitary construction incorporating integral hand guard section 401 having fixed rails for example at the three, nine and twelve o'clock positions relative to the barrel axis. In alternate embodiments, the rails may be positioned as desired. Hand guard 40 has a removable bottom portion 60 with integral lower rail 60R for different mounting options that may be provided. Here, removable accessory device mounting rail 60 is removably connected to the receiver with a hand guard portion mateable with the integral hand guard portion of the receiver. As will be described in more detail below, removable accessory device mounting rail 60 has a quick release lock mounted there to. In alternate embodiments, the quick release lock may be mounted to the receiver. The quick release lock is provided for locking the removable mounting rail to the receiver. As will be described, the quick release lock has a movable locking member movable between locked and unlocked positions. When in the locked position the locking member locks the removable mounting rail in an installed position to the receiver, and when the locking member is in the unlocked position, the mounting rail is unlocked and freely movable relative to the receiver. The locking member has an angled engagement portion protruding from the removable mounting rail and engaging a corresponding angled recess in the receiver. The locking member acts as a wedge in the recess with the removable accessory device mounting rail preloaded with a biasing force against the integral hand guard portion.

In this embodiment the rail 60R may be located at the six (6) o'clock position relative to the barrel axis, though in alternate embodiments the removable rail may be located in any other desired location. The bottom portion 60 may be removable to install other accessories, such a grenade launcher as an example. The removable bottom portion having an integral rail is mounted using a keyed/key way system or tongue and groove system that will be described in more detail below. In the exemplary embodiment shown in FIG. 2, support ring 62 is provided at the front of the receiver 34 for strength and attachment purposes. Lower receiver 44 has interface 68 that removably interlocks with mating interface 70 of upper receiver 34. Interfaces 68, 70 ma, for example, have bores and mating surfaces that lock and unlock allowing the user to lock/assemble and unlock/disassemble the two assemblies, for example by the removal of pins. In alternate embodiments, other mating and locking features could be provided, for example, mating and locking features that do not require tools. In this manner, the modular lower receiver interlocks with the modular upper receiver and different receivers with the same interface can be interchanged without further disassembly. Lower receiver 44 has features such as trigger 72, hammer 74, fire control selector 76, auto sear 78. Lower receiver 44 may have a separable or integral grip 80 and fixtures 82 for mounting stock 42. As may be realized, in alternate embodiments the upper receiver may be coupled conventionally to the lower receiver. Hand guard 40 (formed for example by the joined upper and lower sections 401, 60) has vent holes, integral external rails, heat shields 3, 4 or double heat shields and liners (not shown) to facilitate cooling of the barrel 36 while keeping hand guard 40 at a temperature sufficiently low for an operator to hold. Removable hand guard portion 40 is show operating with a piston based operating system. In alternate embodiments, hand guard 40 may operate with a gas operating system. Additional components may be required for a gas operating system, for example, heat shields around the gas tube. As noted before in this embodiment, the upper receiver 34 and hand guard 401 may be integrally formed as a single member of unitary construction, the one piece hand guard and upper receiver unit may be formed of any suitable metal, such as steel or Al alloy, or may be formed from non-metallic material such as plastic or composites. Rails are provided on Hand guard 40 and may be integrally molded. Hence, the "Piccatiny rails", hand guard and upper receiver may be integral as a one piece member of unitary construction. In alternate embodiments the rails may be removably mounted. In alternate embodiments, more or less multiple rails may be provided in multiple mounting locations or mounting angles on hand guard 40. The rails may be manufactured as part of upper receiver 34 such that collimating between the rail mounted device and the barrel centerline are maintained as desired. Rails are shown as left and right side rails for ambidextrous use. In alternate embodiments, rails may be mounted further forward or rearward or at different angles. Hand guard 40 allows attachment of a removable bottom portion 60 with lower rail 60R for different mounting options that may be provided. The removable bottom portion 60 with rail 60R may be mounted using a keyed/key way system or tongue and groove system. A heat shield may be secured to the upper portion using any suitable attachment means such as screws, pins, rivets. The bottom portion has spring loaded movable detents that lock the bottom portion to the upper portion 6401. Accordingly, the bottom portion may be removably attached to the upper hand guard 401 with spring loaded locks that facilitate ease of removal and reattachment of the bottom and upper hand guard portions.

Figure 3:
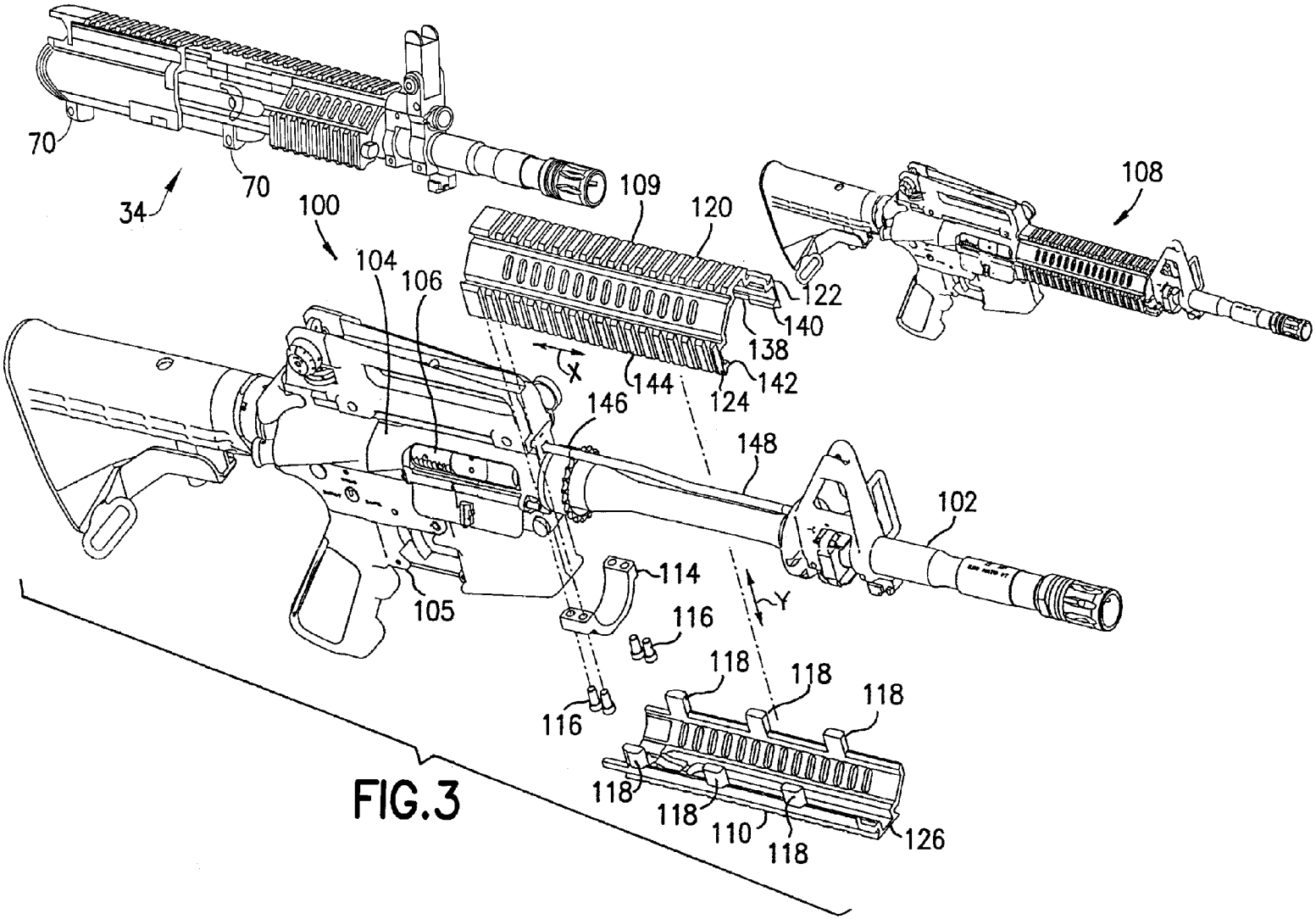
FIG. 3 is an exploded isometric view of an automatic firearm incorporating features in accordance with an exemplary embodiment.

Referring now to FIG. 3, there is shown an exploded isometric view of an automatic firearm incorporating features in accordance with an exemplary embodiment. Firearm 100 is generally similar to firearm 30 in FIG. 1, except as otherwise noted. Firearm 100 may have an upper receiver 104 with barrel 102 connected to upper receiver 104 with barrel nut 146. Firearm 100 may further have gas actuation system 148, lower receiver 105, hand guard 108, and bolt 106. Firearm 100 may have an operating mechanism in the receiver having a trigger, hammer, and fire control selector. Firearm 100 may have a magazine well provided at the front of lower receiver 105. In the exemplary embodiment shown hand guard 108 is provided having an upper portion 109 and removable lower hand guard portion 110. As may be realized hand guard 108 in this embodiment may be used to replace a conventional hand guard. Thus, hand guard 108 is retrofittable onto otherwise conventional M-4 type rifles. Firearm 100 may have features in lower receiver 105 similar to the features 68 in lower receiver 44 shown in firearm 30 of FIG. 2. Upper receiver 34 may be retrofitted to firearm 100 by nature of mating features 70 interfacing with corresponding features on lower receiver 105 of forearm 100. For example, upper receiver 34 with the unitary hand guard may fit on any M4, M16, or AR15 lower receiver and be retrofittable through the entire range. Here, upper receiver 34 and corresponding components may be provided as a conversion kit for replacing an old upper receiver. Here, the lower receiver assembly is removably and interlockingly secured to the upper receiver assembly, where the lower receiver is selectable from different interchangeable lower receivers each having different characteristics and each having a common interface to the upper receiver. As seen in FIG. 3, upper portion 109 may be clamped to firearm 100 with clamp member 114 and fasteners 116. Clamp member 114 clamps upper hand guard portion 109 to barrel nut 146. In alternate embodiments, alternate mounting techniques may be provided. The removable clamp portion 114 provides frictional clamping with contact onto the body of barrel nut 146 and clears the scallops on barrel nut 146. A gas tube groove is provided on upper portion 120 for clearance and/or to provide positioning relative to the receiver. The width of lower clamp member 114 allows the clamp member to sit within the width of nut 146 to avoid interference with the gas tube scallop ring. Heat shields, similar to shields 3, 4 in FIG. 3, may be snap mounted or otherwise mounted to upper portion 109 and/or lower portion 110. In this embodiment upper portion 109 may for example have 9 o'clock rail 124, 12 o'clock rail 120 and 3 o'clock rail 122. In the exemplary embodiment, lower portion 110 has 6 o'clock rail 126. In alternate embodiments, the lower portion of the hand guard may have more or fewer accessory device mounting rails. In the embodiment shown, no support ring is shown on upper portion 109; in alternate embodiments a front support ring may be provided. Lower portion 110 is coupled to the upper portion 109 via tongue and groove mating. Access spaces or grooves 138, 144 are provided in upper portion 109 to mate insert tongues 118 into upper rail 109. Support surfaces 140, 142 engage surfaces 119 and are provided to allow retention of lower portion 110 by moving lower portion up (in the direction indicated by arrow Y) and then sliding lower portion 110 back (in the direction indicated by arrow X). In alternate embodiments, lower portion may be otherwise retained, for example, by sliding forward. Spring loaded latch 128 pivots on pin 130 and engages a detent or slot in the clamp 114 bottom surface. Here, Latch push pad 129 is recessed into rail 126. Grooves 136 may be provided to allow snap mounting of a heat shield. Here, lack of a support ring allows a shield to extend forward so that when installed front of shield becomes flush without a support ring in the way. An upper heat shield portion may be provided for attachment around the gas tube. Here, retrofittable rail 108 may be provided for attachment to an existing rifle. Here, a retrofittable four position rail is provided that may be put on an existing rifle or cartridge.

Figure 4:
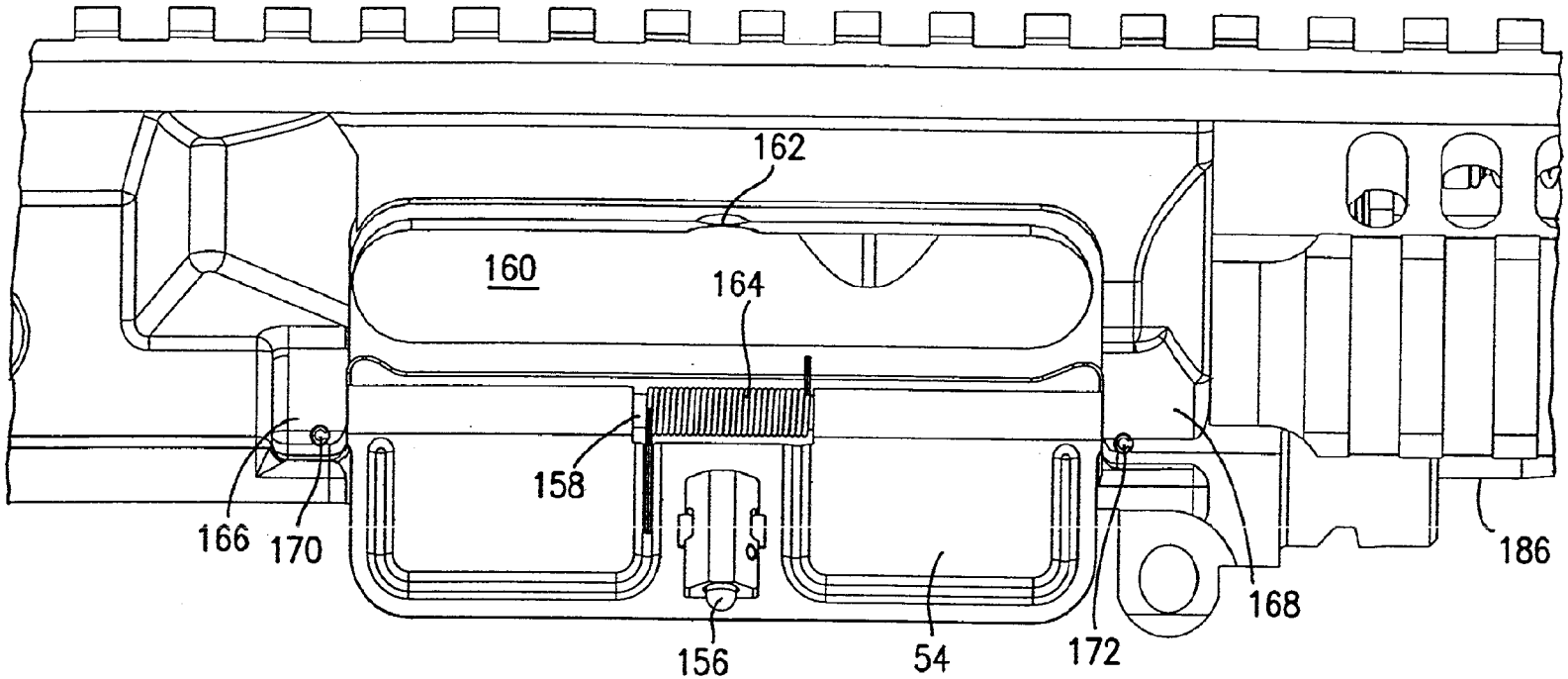
FIG. 4 is a side elevation view of an ejection port cover.
Figure 5:
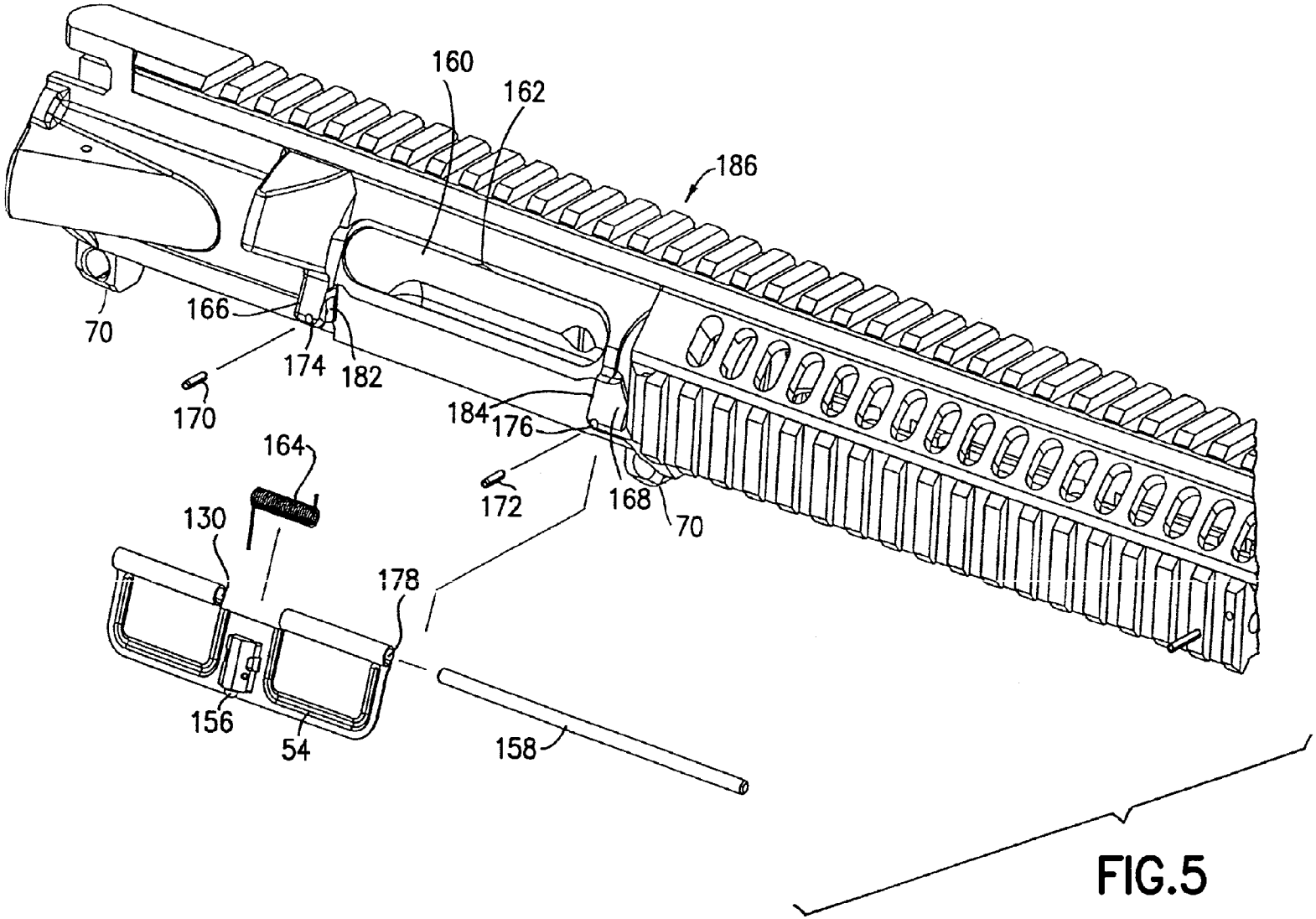
FIG. 5 is an exploded view of the ejection port cover shown in FIG. 4.
Figure 6:
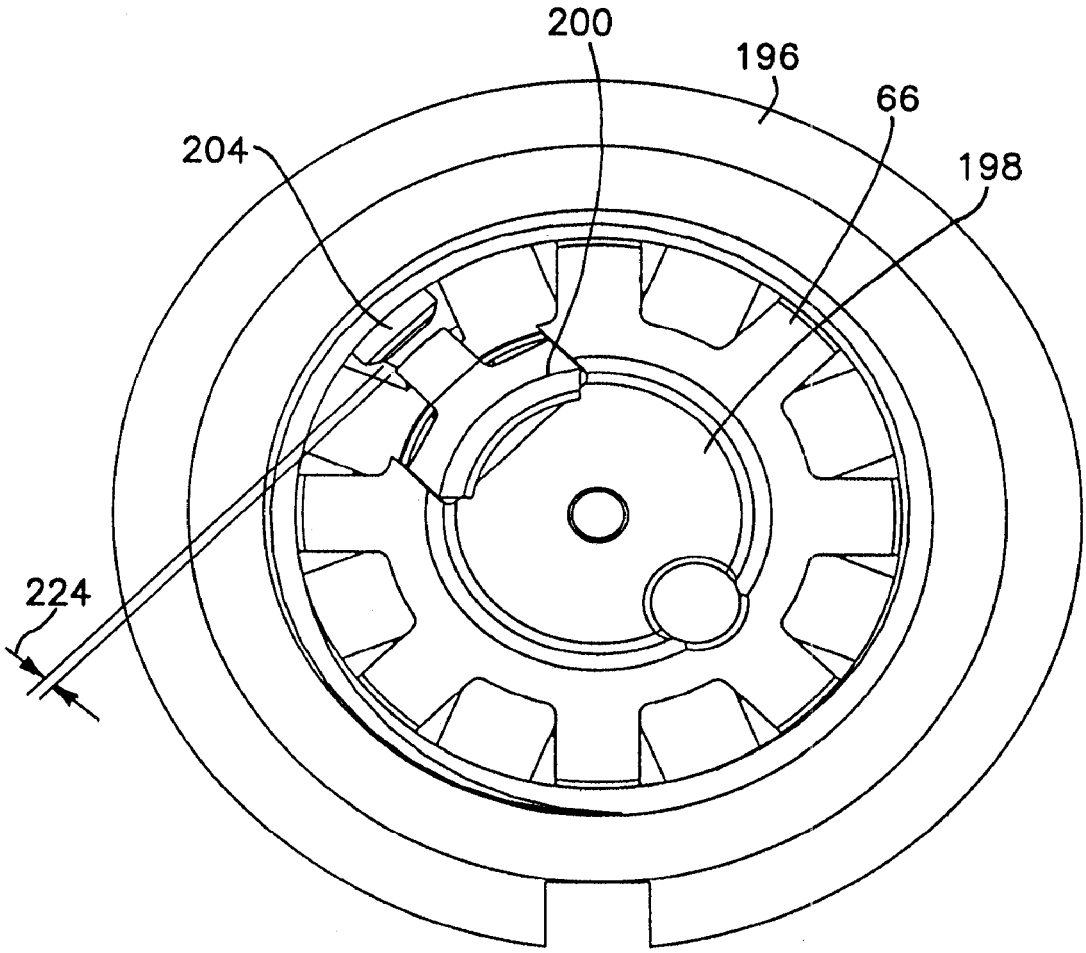
FIG. 6 is a view of a barrel extension and bolt carrier.
Figure 7:
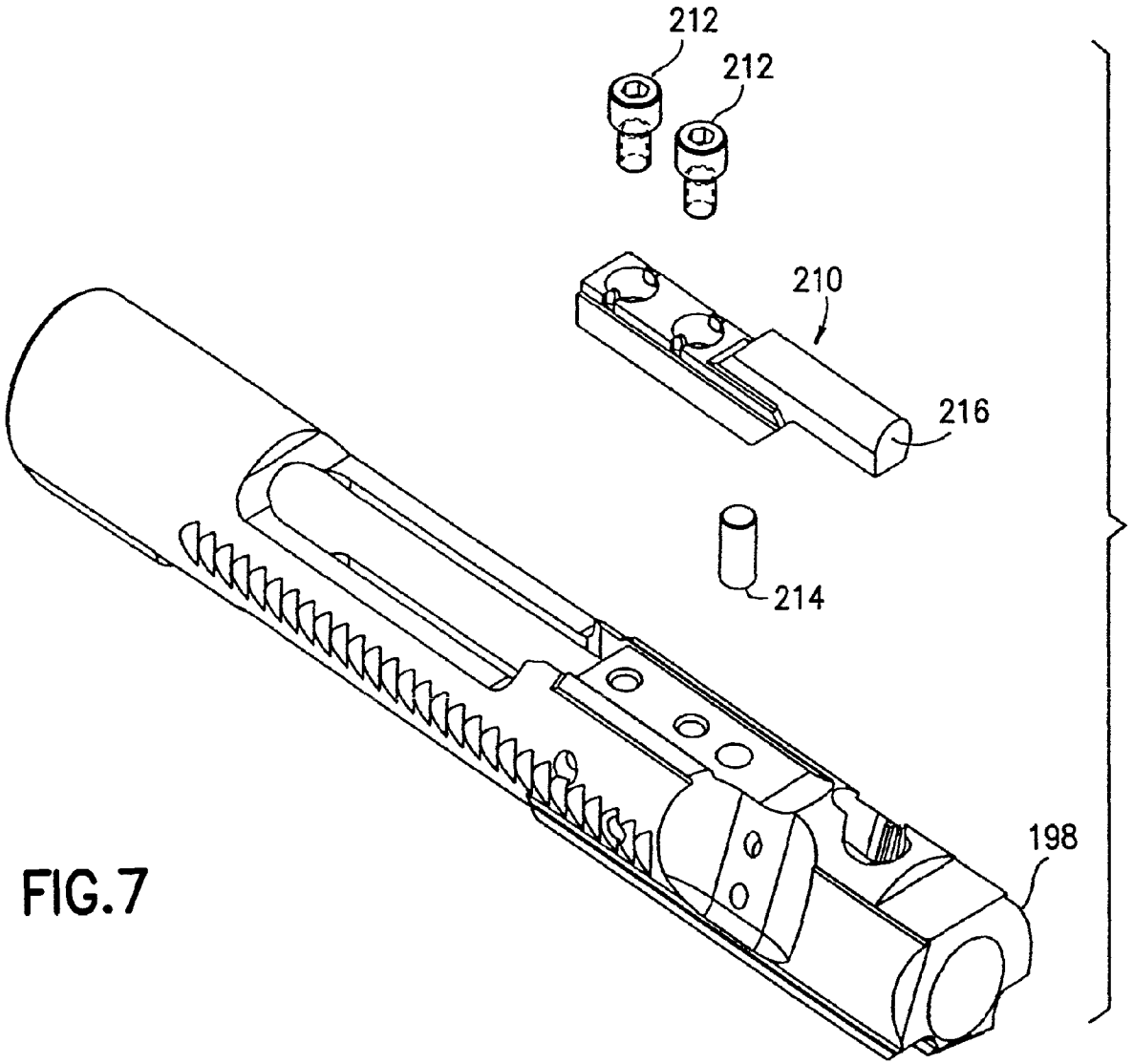
FIG. 7 is an exploded isometric view of a bolt carrier.
Figure 8:
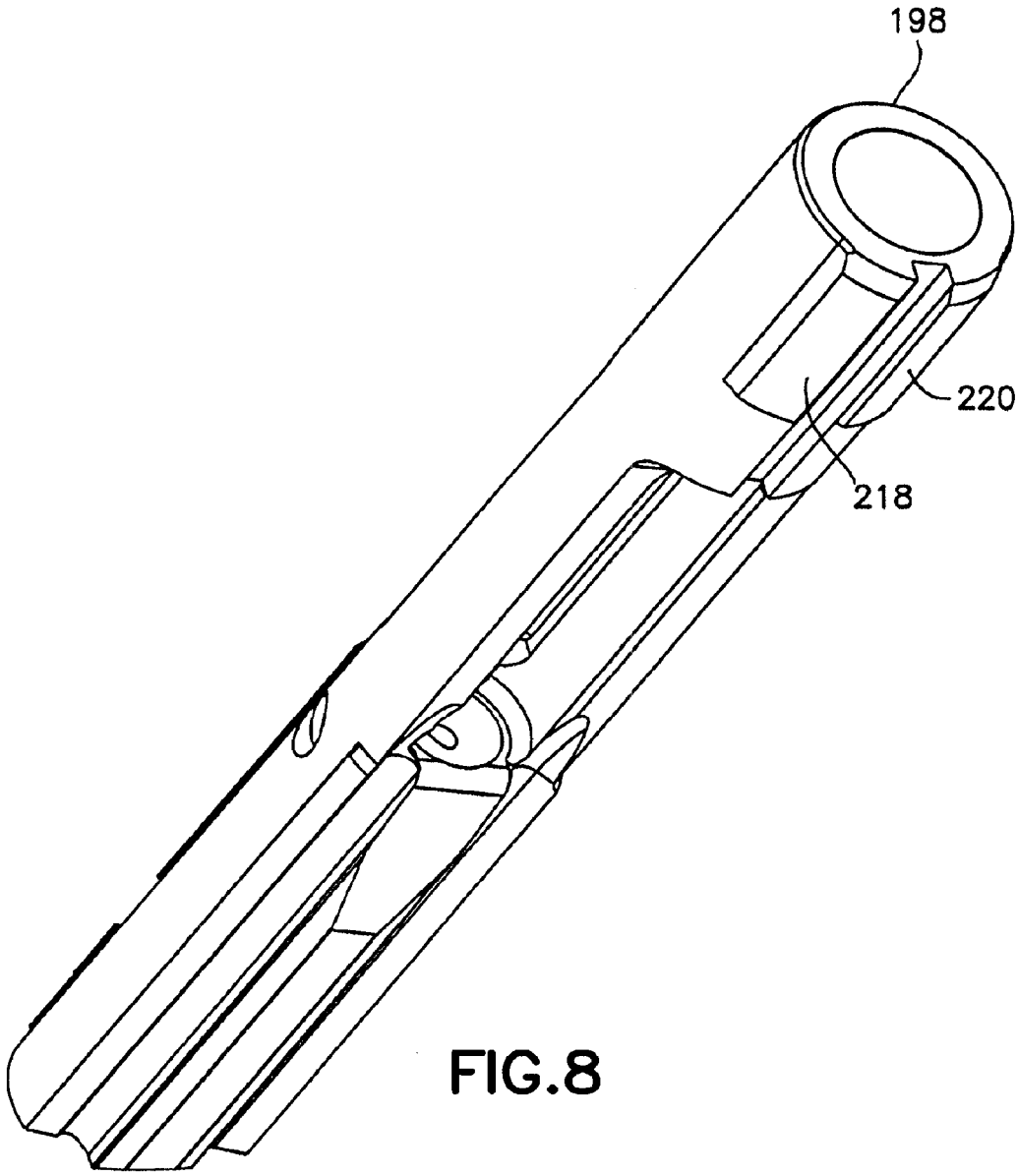
FIG. 8 is an isometric view of a bolt carrier.
Figure 9:
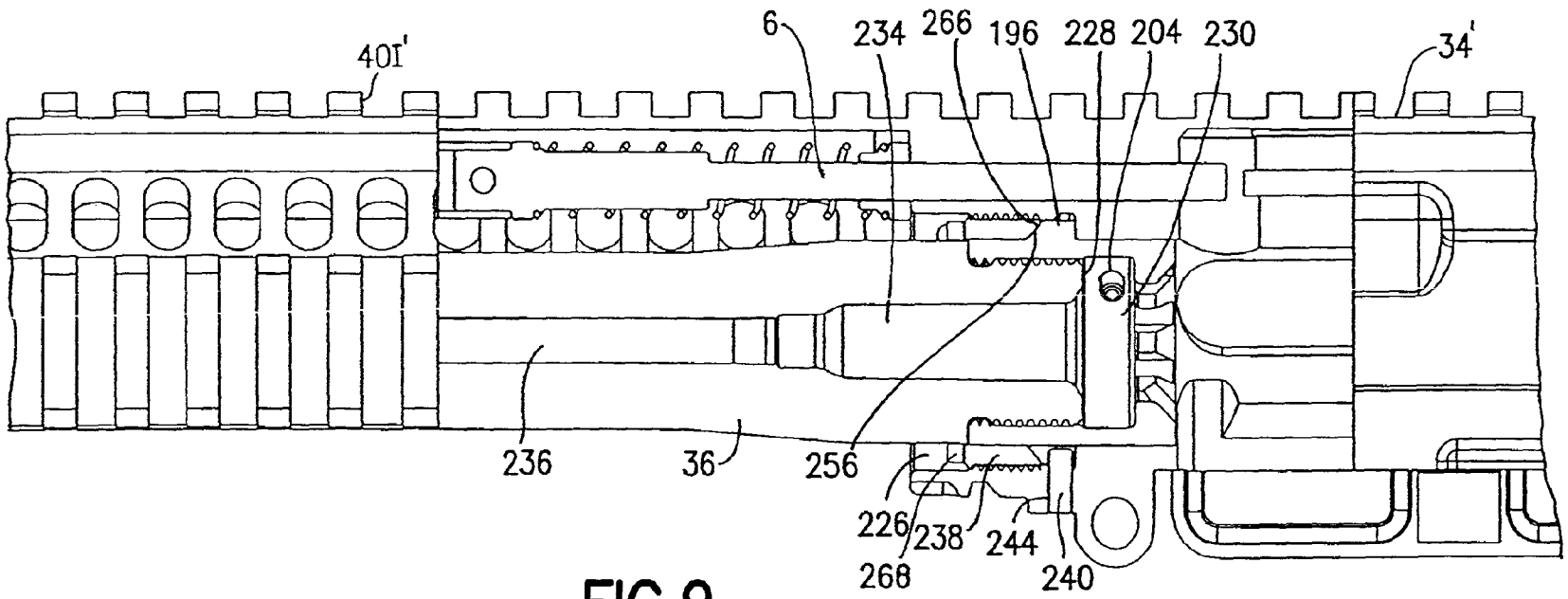
FIGS. 9-9A are respectively a partial section view and partial cut-away isometric view of the receiver and barrel assembly.
Figure 9A:
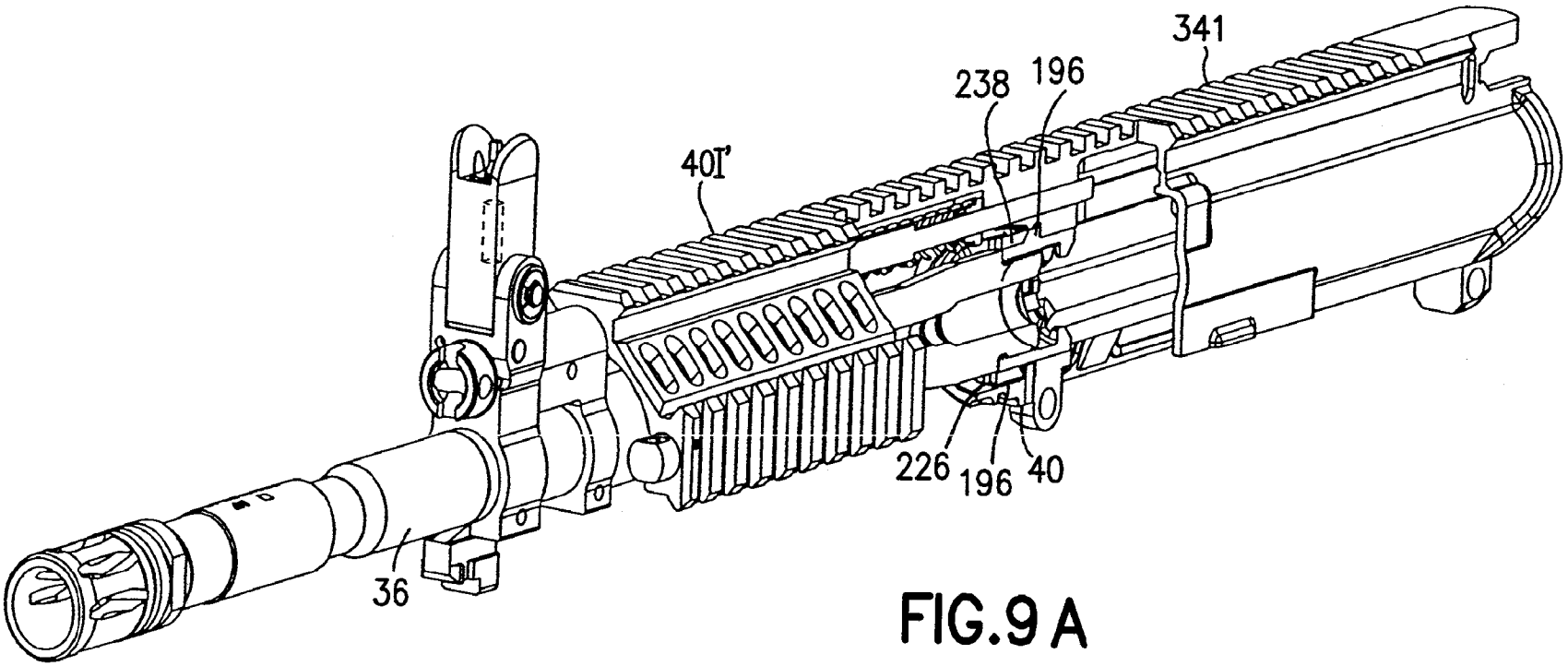
Figure 10:
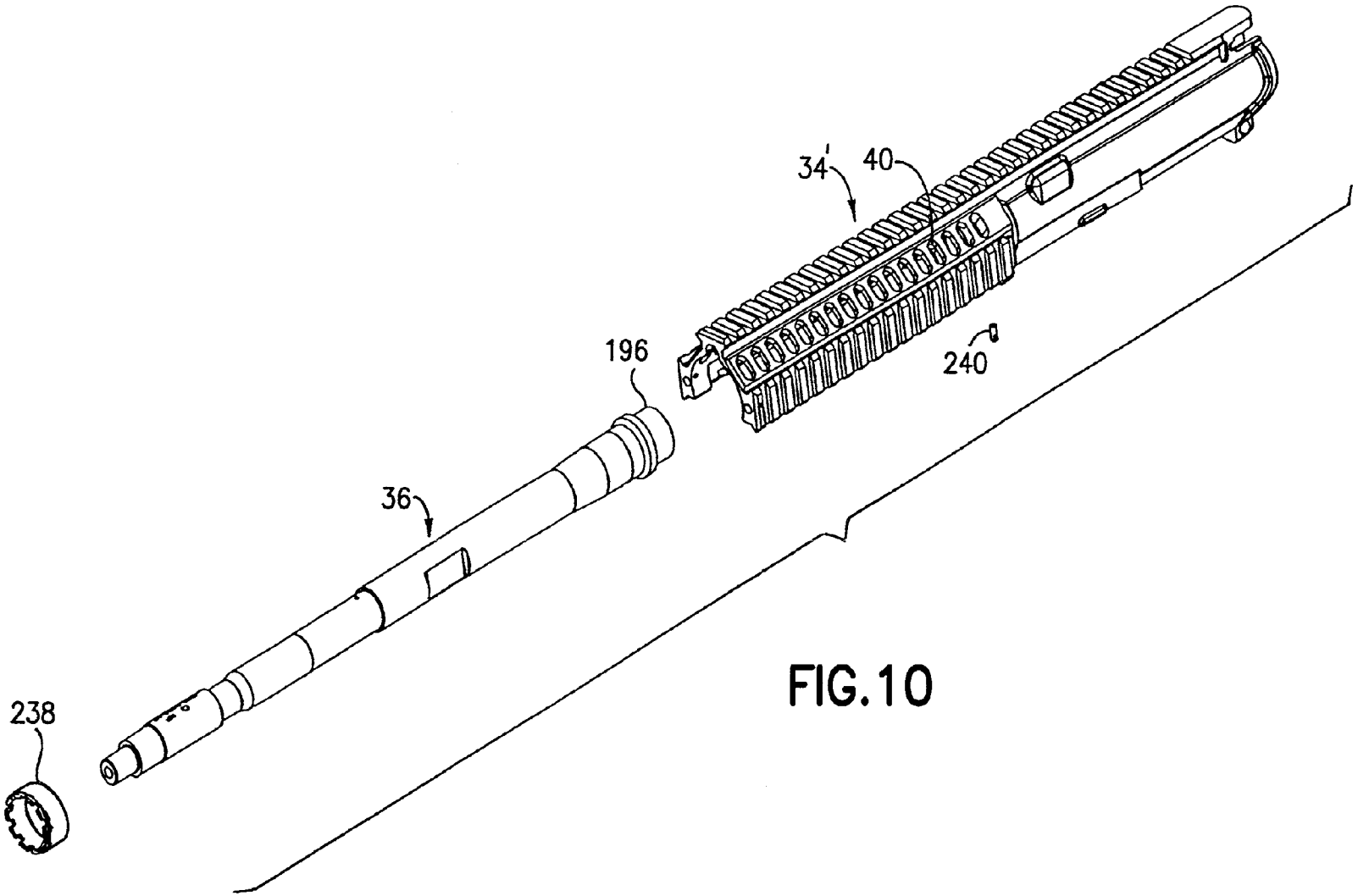
FIG. 10 is an isometric view of barrel assembly.
Figure 11:
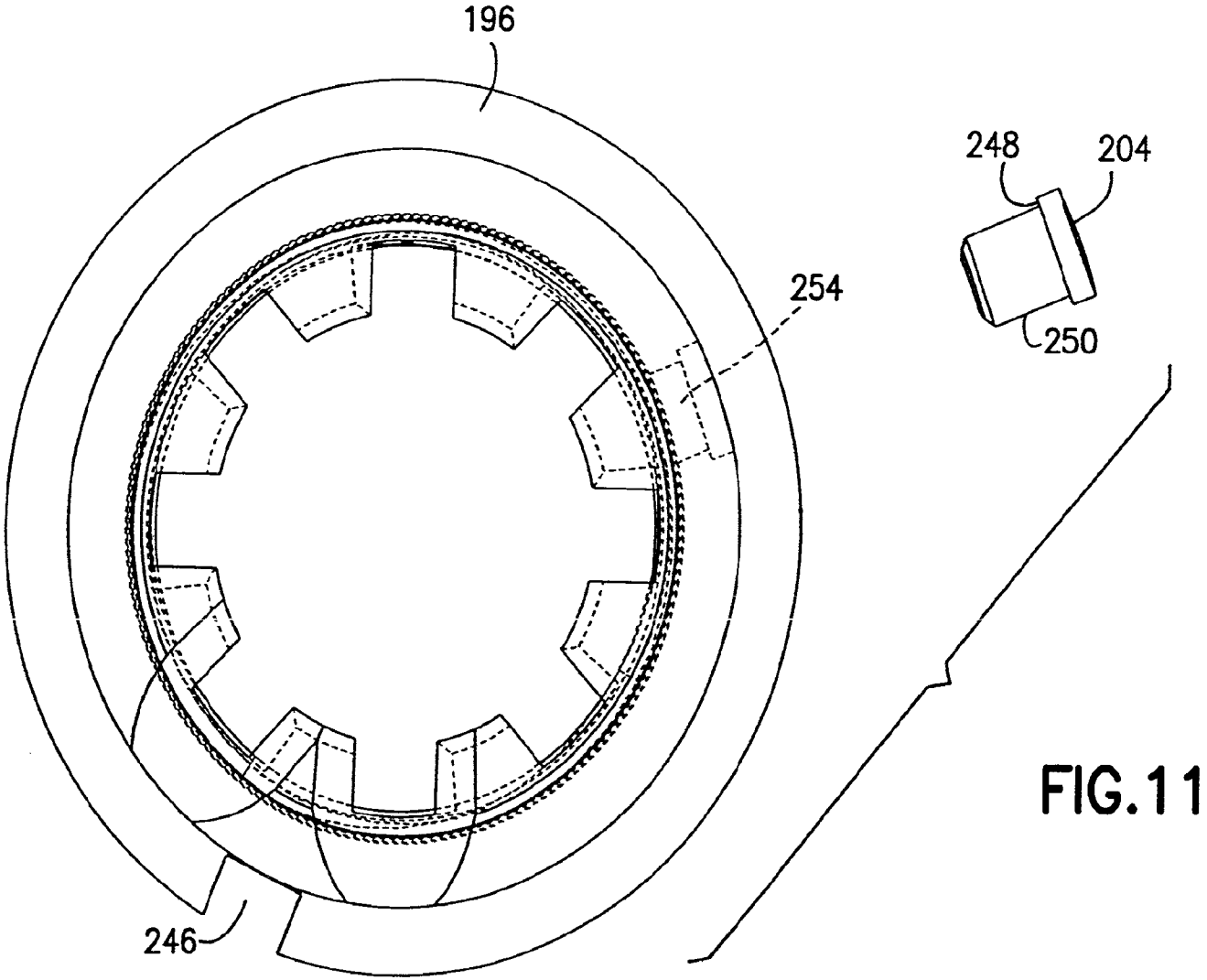
FIG. 11 is an exploded view of a barrel extension.
Figure 12:
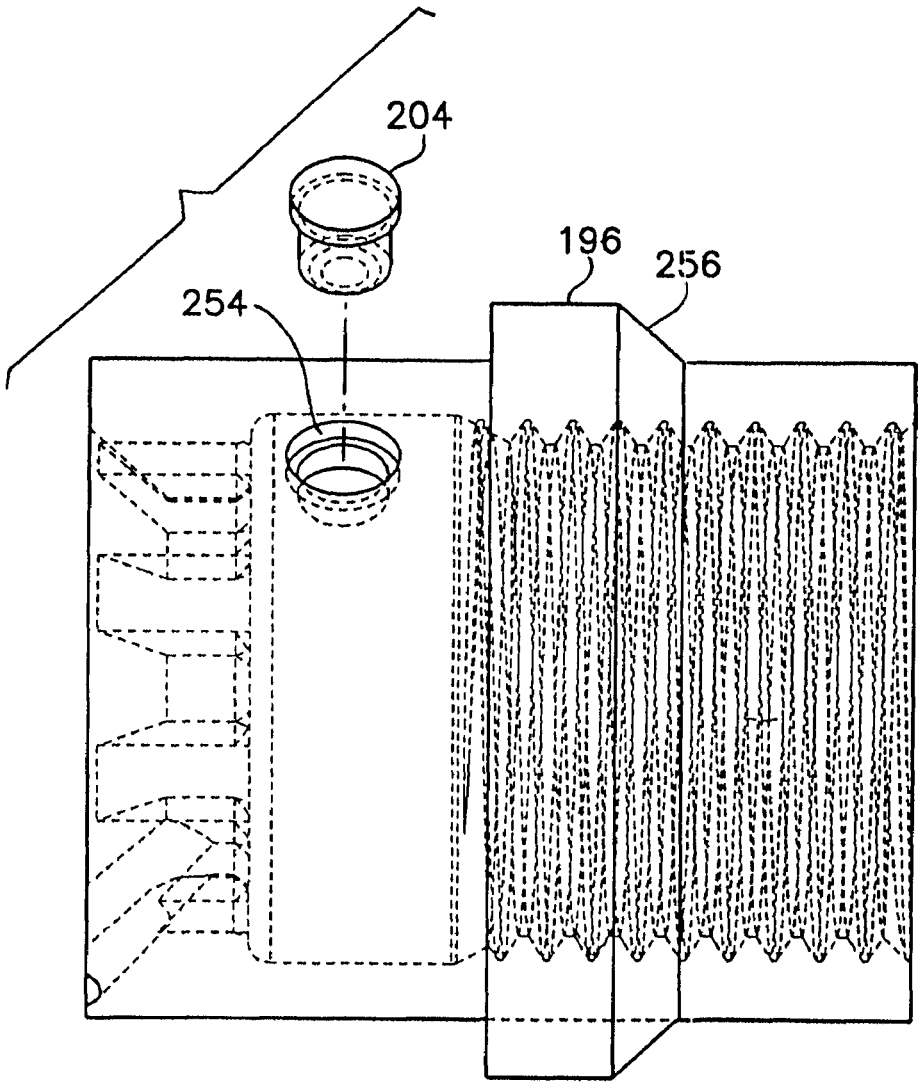
FIG. 12 is an exploded view of a barrel extension.
Figure 13:
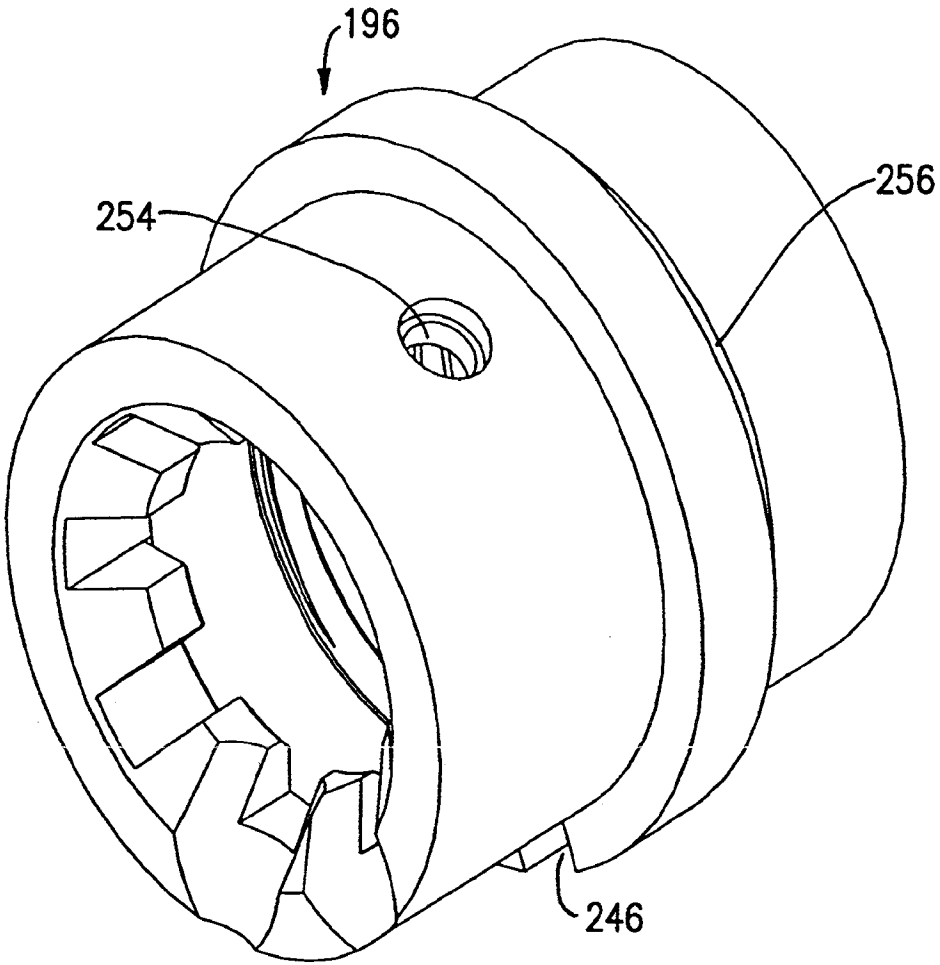
FIG. 13 is an isometric view of a barrel extension.
Figure 14:
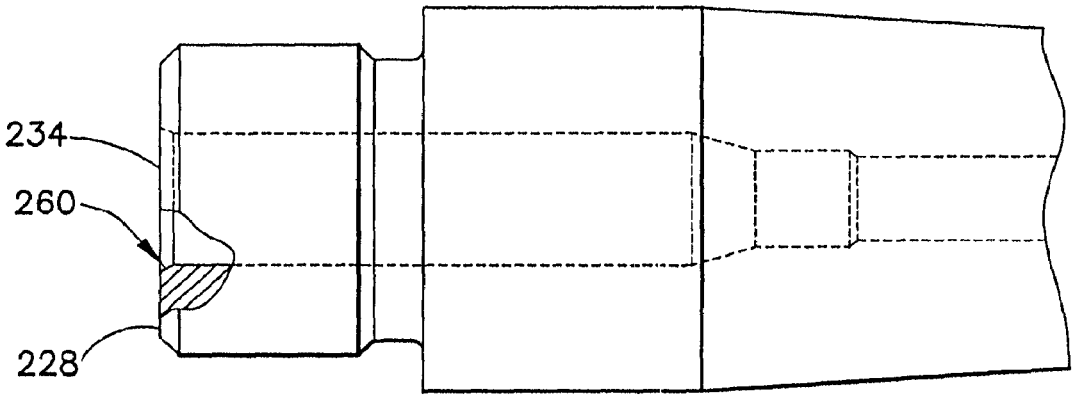
FIG. 14 is a side view of a barrel.
Figure 15:
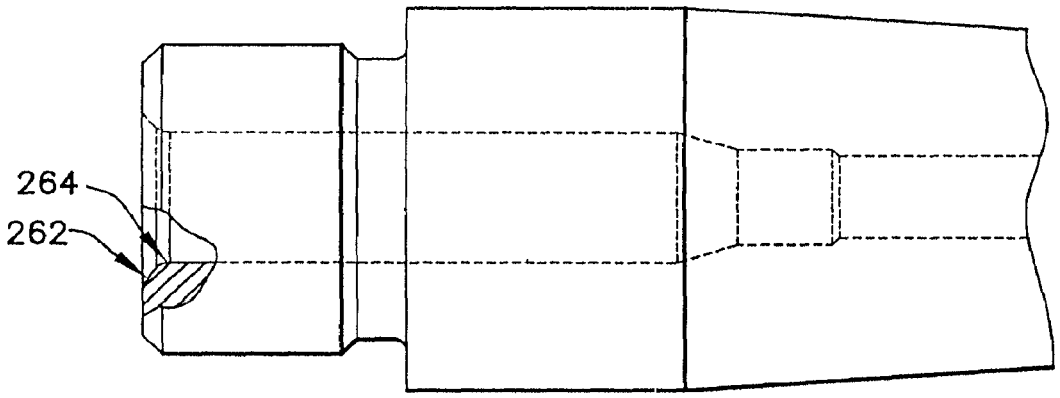
FIG. 15 PRIOR ART
FIG. 15 is a side view of a barrel.
Figure 16:
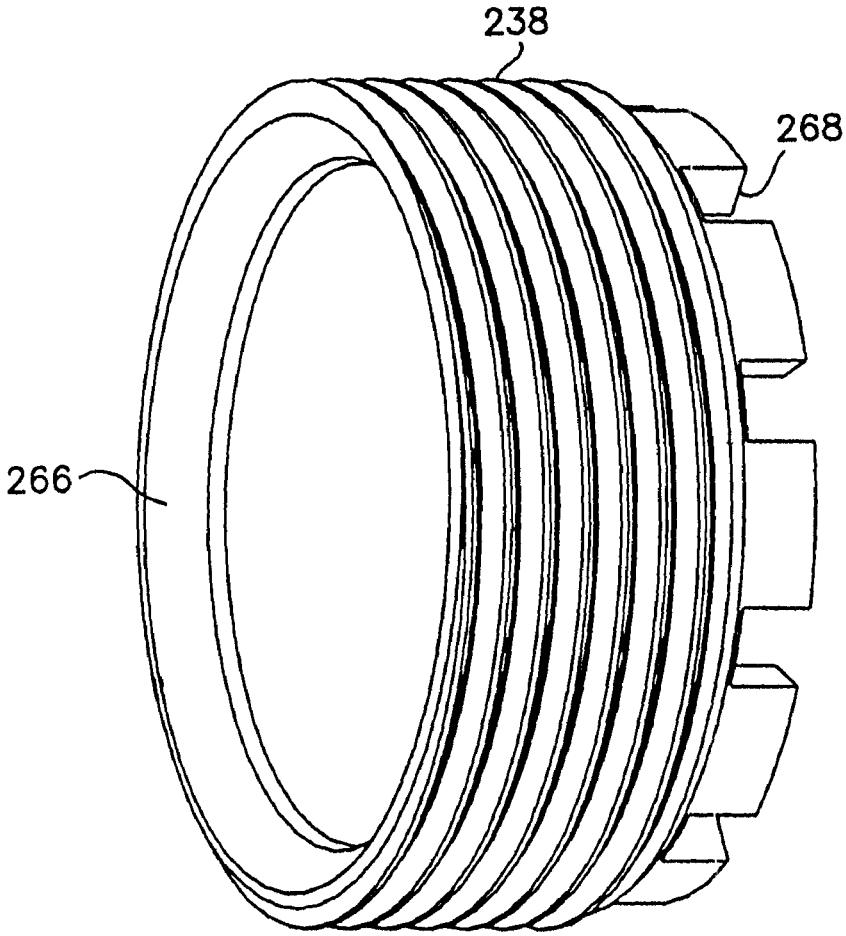
FIG. 16 is an isometric view of a barrel nut.

Referring now to FIG. 4, there is shown a side elevation view of an ejection port cover. Referring also to FIG. 6, there is shown an exploded view of the ejection port cover shown in FIG. 4. On a conventional firearm, for attachment of the ejection port door, a one piece rail may prevent sliding of pin axially due to interference from rails. In the embodiments shown, grooves or slots 182, 184 are formed on bottom of mounting lugs 166, 168. Pin 158 may be provided to slide up into lugs 166, 168. Taps or pin holes 174, 176 may be provided transverse towards the receiver to accept screws or pins 170, 172. Holes 174, 176 may extend through the receiver wall into the receiver inner space. In this manner, access may be provided to push out the pins 170, 172 into the interior of disassembled receiver for removal. Ejection port door 54 may be provided and slides over pin 158. Here, bosses 166, 168 may be provided, slotted on the bottom and pin 158 may be slid in with a cross pin to hold it in place. Spring 164 and detent 156 are provided to maintain the position of door 54 as desired. Referring now to FIG. 6, there is shown a view of a barrel extension and an extractor 200. Referring also to FIG. 7, there is shown an exploded isometric view of a bolt carrier. Referring also to FIG. 8, there is shown another isometric view of the bolt carrier. As may be realized bolt carrier 198 holds a bolt with extractor 200. As seen best in FIG. 6, in this embodiment, barrel extension 196 has extractor locking pin 204 provided having gap 224 between extractor locking pin 204 and extractor 200. Gap 224 is shown with extractor 200 in a position without a cartridge in place. When a cartridge is in place, gap 224 may be reduced, such as to 0.005 inches nominal where extractor 200 flexes to retain the cartridge. As seen best in FIG. 7, in the exemplary embodiment bolt carrier 198 is provided for use with a gas piston or indirect gas operating system, as will be described below, that operates against carrier key 210. In the exemplary embodiment, the key may be a solid key. Pin 214 is provided with two screws 212 to hold carrier key 210 to bolt 198. In alternate embodiments, other attachment methods may be provided. Carrier key has impingement face 216 to interface with the indirect gas operating system's rod. As seen best in FIG. 8, skids 218, 220 are provided on the back of carrier 198. Skids 198, 220 are provided such that when bolt carrier 198 is impacted by the piston of an indirect gas operating system (e.g. impinging the impingement face 216 and hence impinging on the bolt carrier offset from the centerline of bolt carrier 198 and generating an overturning moment causing the back end of bolt carrier 198 to kick down), the skids provide a raised compensating surface on the lower rear portion of bolt carrier 198 to counter the overturning moment and distribute the loading on the bolt carrier 198 thereby allowing the bolt carrier to slide smoothly rearwards towards the receiver extension. Referring now to FIGS. 9-9A, there is shown a respectively partial section view and partial cut away perspective view of an upper receiver 34 and a barrel assembly in accordance with another exemplary embodiment. Referring also to FIG. 10, there is shown an exploded isometric view of the receiver 341 and barrel assembly. Referring also to FIG. 11, there is shown an exploded view of a barrel extension. Referring also to FIG. 12, there is shown an exploded view of the barrel extension. Referring also to FIG. 13, there is shown another isometric view of the barrel extension. Referring also to FIG. 14, there is shown a side view of a barrel. Referring also to FIG. 15, there is shown another side view of the barrel. Referring also to FIG. 16, there is shown an isometric view of a barrel nut.

Receiver 34' is substantially similar to receiver 34 described previously, except as otherwise noted. Similar features are similarly numbered. Receiver 34' is, as shown in FIG. 11A, a one piece member of unitary construction with an integral hand guard 401'. In the exemplary embodiment shown in FIGS. 9-9A, gas piston system is depicted disposed between barrel and receiver 34 for example purposes. In alternate embodiments, the firearm may have a gas tube in place of the gas piston system. As seen best in FIGS. 9-9A, the receiver 34' has a bore 226 in the barrel. Assembly is received and mated to the receiver as will be further described below. In the exemplary embodiment, barrel assembly generally includes barrel 36, barrel extension 196 and a barrel nut 238. Barrel 36 has bore 236, a breach with cartridge receiving section 234 and bolt interfacing surface 228. The barrel extension 196 is threaded onto barrel 36 with both threads and seating surface for positive location. In alternate embodiments, the barrel extension may be interfaced with the barrel in any other manner. In alternate embodiments, barrel extension 196 may be integrally formed as part of barrel 36. In alternate embodiments, bolt interfacing surface may have a different shape, such as a cone shape or other suitable shape. Barrel extension 196 is placed in bore 226 having a flange that stops against a flange of bore 226. Barrel extension 196 has taper 256 to center and lock barrel extension 196 in position and to increase the clamped surface area. The barrel in combination with barrel extension may be attached to the receiver with barrel nut 238. Barrel nut 238 is provided to clamp and lock barrel 36 into counter bore 226 of the receiver. Barrel 36 attachment is accomplished via taper 256 on barrel extension 196. Barrel nut 238 is threaded on the outside for engaging internal threads in bore 226. Extension flange 268 is provided on barrel nut 238 and provides engagement for wrench (e.g. spanner wrench) inside bore 226 for example, the flange 268 of the barrel nut may be castleated as shown in FIG. 1B. By providing barrel nut 238 as shown, the nut 238 may be removed or installed in the receiver 34' of unitary construction with integral hand guard and without, for example, removing a gas piston operating system or a gas tube. Here, for example, nut 238 has an outer circumference that clears the gas operating system G. Angled interior mating surface 266 (see also FIG. 16) on barrel nut 238 is provided for centering of the barrel 36 via mating clamping and centering surface 256 of barrel extension 196 (see also FIG. 12). The interior of the bore 226 of the receiver 32A is provided with inner threads that engage the outer threaded barrel nut 238. As may realized, the tapered surfaces 256, 266 respectively on the barrel extension and barrel nut provide additional surface area for frictional clamping and cooperate to centralize the barrel due to the matching taper on the nut and barrel. Here, the combination of barrel nut 238, extension 196 and bore 226 provides very effective locking, barrel centering, and eliminates the potential for the barrel to move relative to the receiver as any tolerance related clearances or play between the barrel and receiver are eliminated. In the exemplary embodiment, a locating notch 246 may be provided in barrel extension 196 (see FIGS. 11 and 13) for index pin 240 to positively locate the barrel 36 in the proper orientation. Barrel index pin 240 may be pressed into bore 244 on the bottom of the upper receiver 34' from underneath. In this manner, a stronger interface may be provided, for example, as pin 240 may be longer and softer material and may be less likely to deform metal. As seen in FIGS. 11-12, in the exemplary embodiment, extractor locking pin 204 may be provided, pressed into barrel extension 196. As noted before extractor locking pin 204 acts as a backing surface for extractor 200. In alternate embodiments, any suitable surface may be provided. Extractor locking pin 204 may be provided, for example, on any M-4 or other suitable firearm. Extractor lock pin 204 is provided in barrel extension 196 and positioned to back up extractor 200. In alternate embodiments, extractor locking pin may be provided on any suitable barrel. Referring also to FIG. 6, extractor 200 may have a typical clearance 224, for example of 0.005". In alternate embodiments, other suitable clearances may be provided. Bullet casing flexure, for example in the event of over pressure due to barrel obstruction, may move back extractor 200 and close gap 224 to abut extractor lock pin 204. In the embodiment shown, pin 204 may be fixed in place and press fit into extension 196.

As will be described further, in the embodiment shown in FIG. 14, a reduced radius 260 may be provided between cartridge receiving section 234 and bolt interfacing surface 228. As may be realized by comparison with the representative conventional barrel shown in FIG. 15, in the exemplary embodiment the cartridge entry ramp or chamfer 262 is eliminated and replaced with entry radius 260 to reduce the unsupported length of a cartridge, This reduces the chance for cartridge failure. As noted before, the extractor locking pin 204 effectively locks extractor 200 in place tending to minimize the chance of failure, for example where the cartridge deflection under pressure would cause extractor 200 to flex excessively resulting in a failed extraction or otherwise. To further mitigate risk of failure, radius surface 260 at the mouth of cartridge receiving section 234 is minimized. Radius 260 is provided off face 228 of barrel 36 on the inside and rolls into chamber 234. Here, radius 260 is interface between the inner surface of the chamber 234 and face 228. Reduced radius 260 provides a shaper corner and provides more support for the casing. In contrast, a conventional cartridge entry ramp 262 having angled or cone 262 and radius 264 as shown in FIG. 15 provides less cartridge support. Radius 260 reduces the empty space and provides additional backing surface for the casing where the casing, in the region where be a weak link reducing the chance of brass failure. The weakest part of the casing is the back area. If the casing fails, it will tend to blow out in the area around the extractor due to lack of support. In the exemplary embodiment the flexure of extractor 200, provided on the bolt (not shown) is snubbed by contact with pin 204. Here, pin 204 supports the extractor 200 prevents casing failure by stopping extractor 200 from excessive flex. Here, the combination of radius 260 and pin 204 significantly reduce the chance of such failure. In this manner, the rear of the cartridge casing that is unsupported is minimized. Radius 260 may have any desired size, for example from 0.030 inches to 0.050 inches and may be polished. In alternate embodiments, radius 260 may be different. In other alternate embodiments, the entry surface may be generally rounded to provide the desired support while ensuring proper feed of the cartridge into the chamber.

Figure 17:
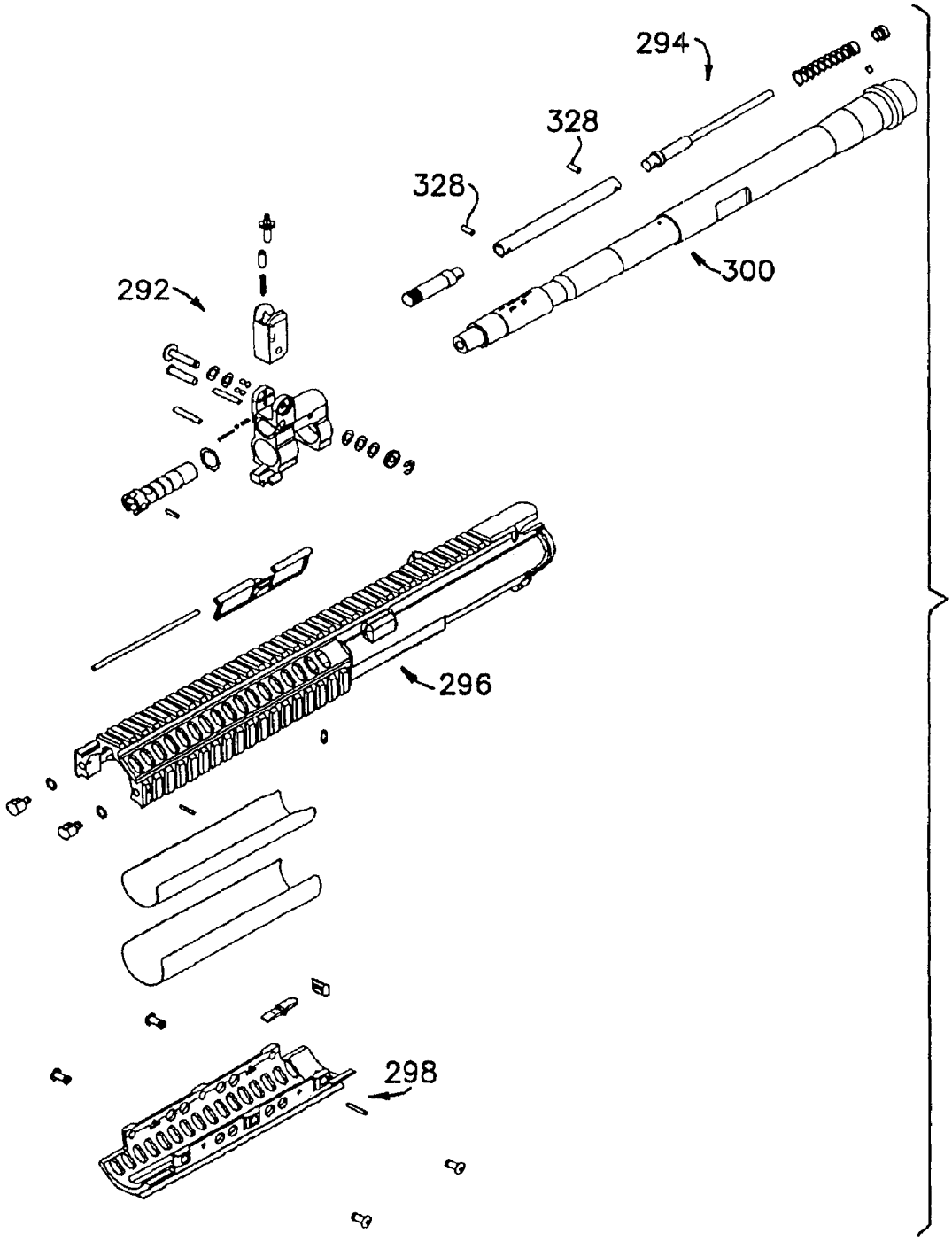
FIG. 17 is an exploded isometric view of a sight and gas piston assembly.
Figure 18:
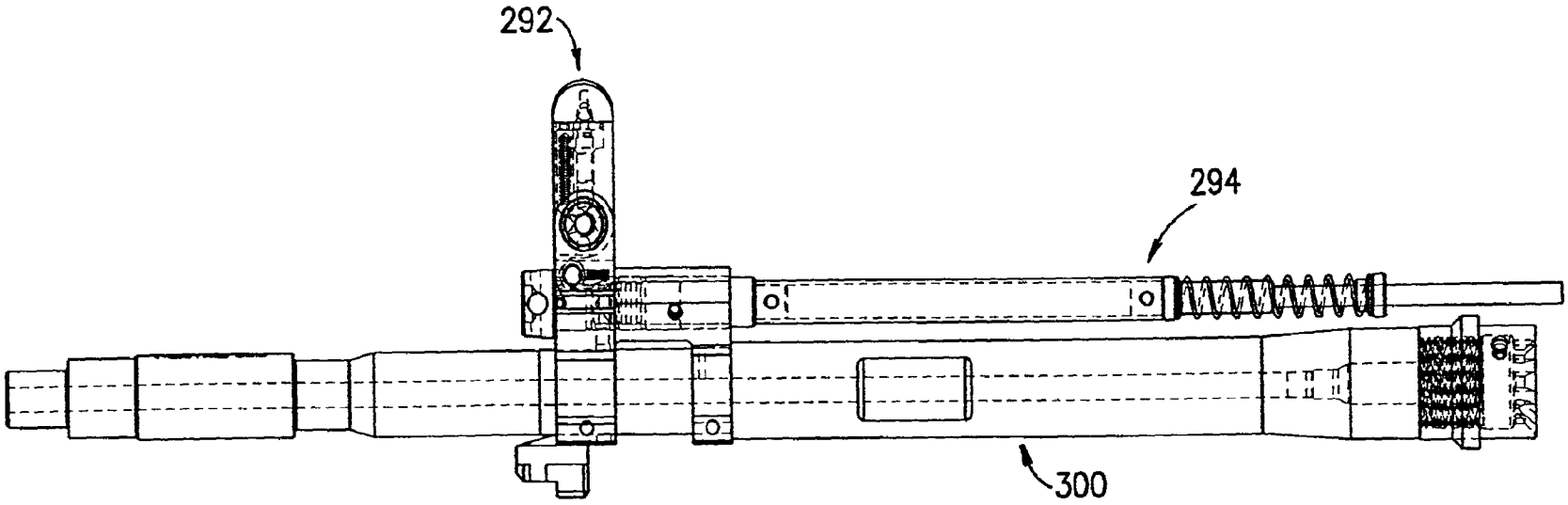
FIG. 18 is a side view of a sight and gas piston assembly.
Figure 19:
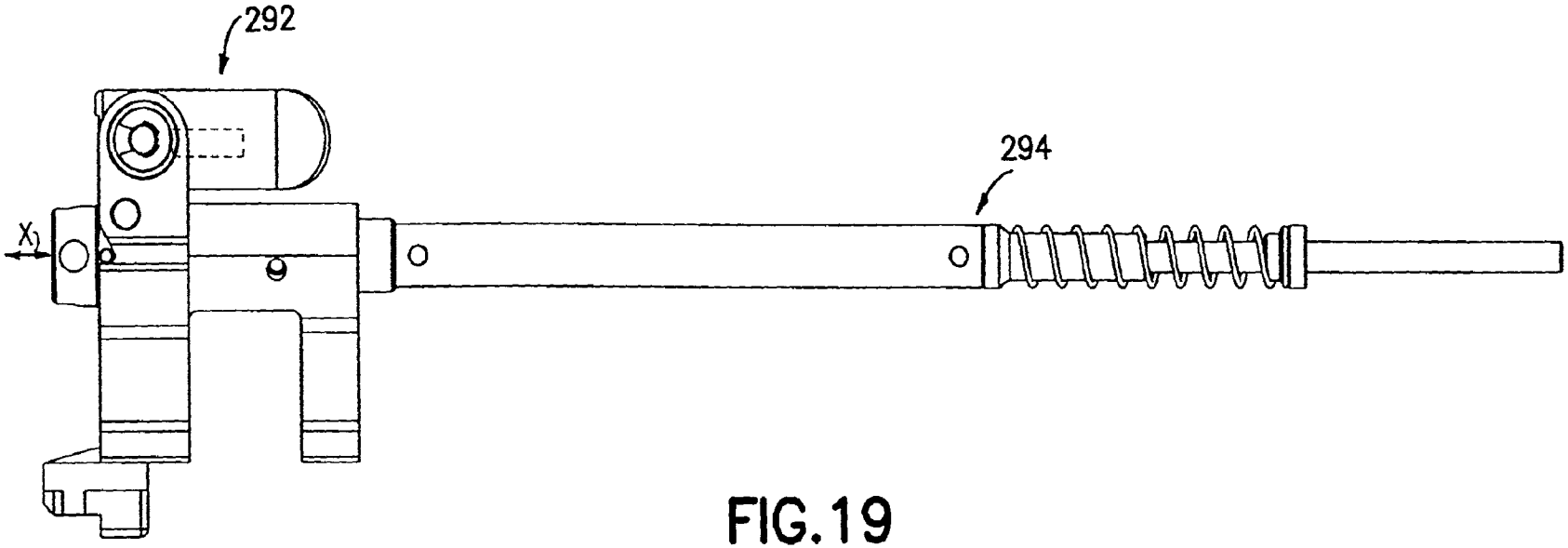
FIG. 19 is a side view of a sight and gas piston assembly.
Figure 20:
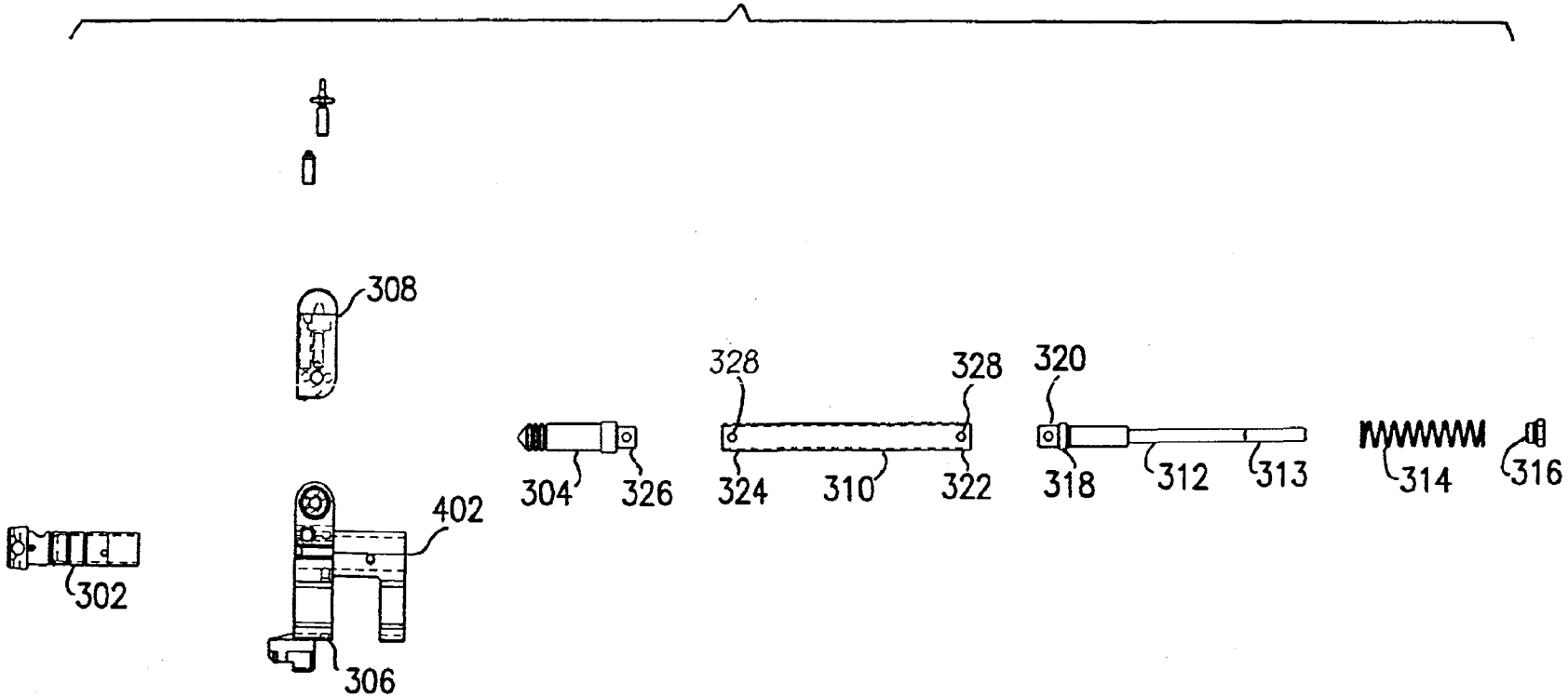
FIG. 20 is an exploded side view of a sight and gas piston assembly.
Figure 21:
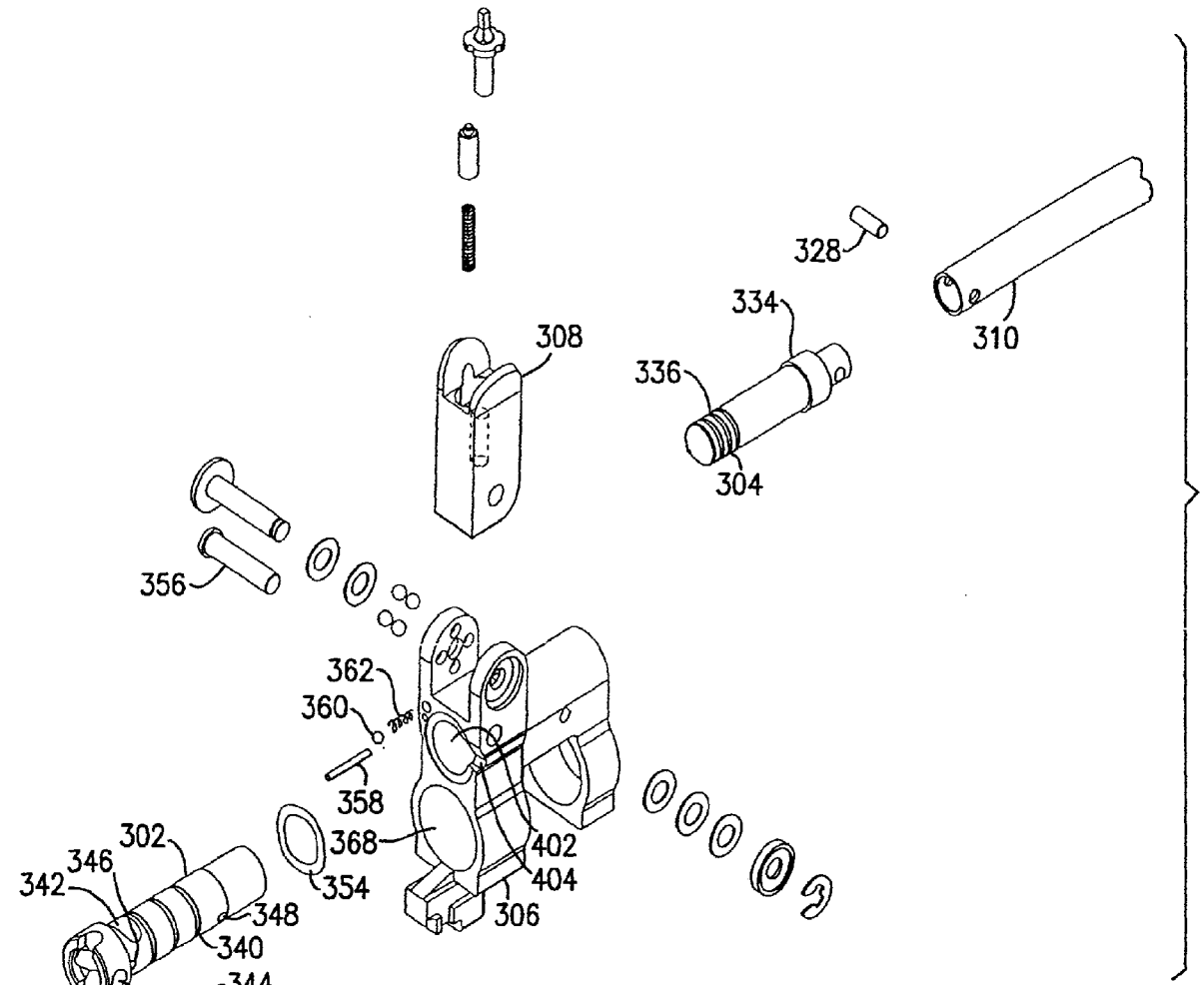
FIG. 21 is an exploded isometric view of a sight and gas piston assembly.
Figure 22:
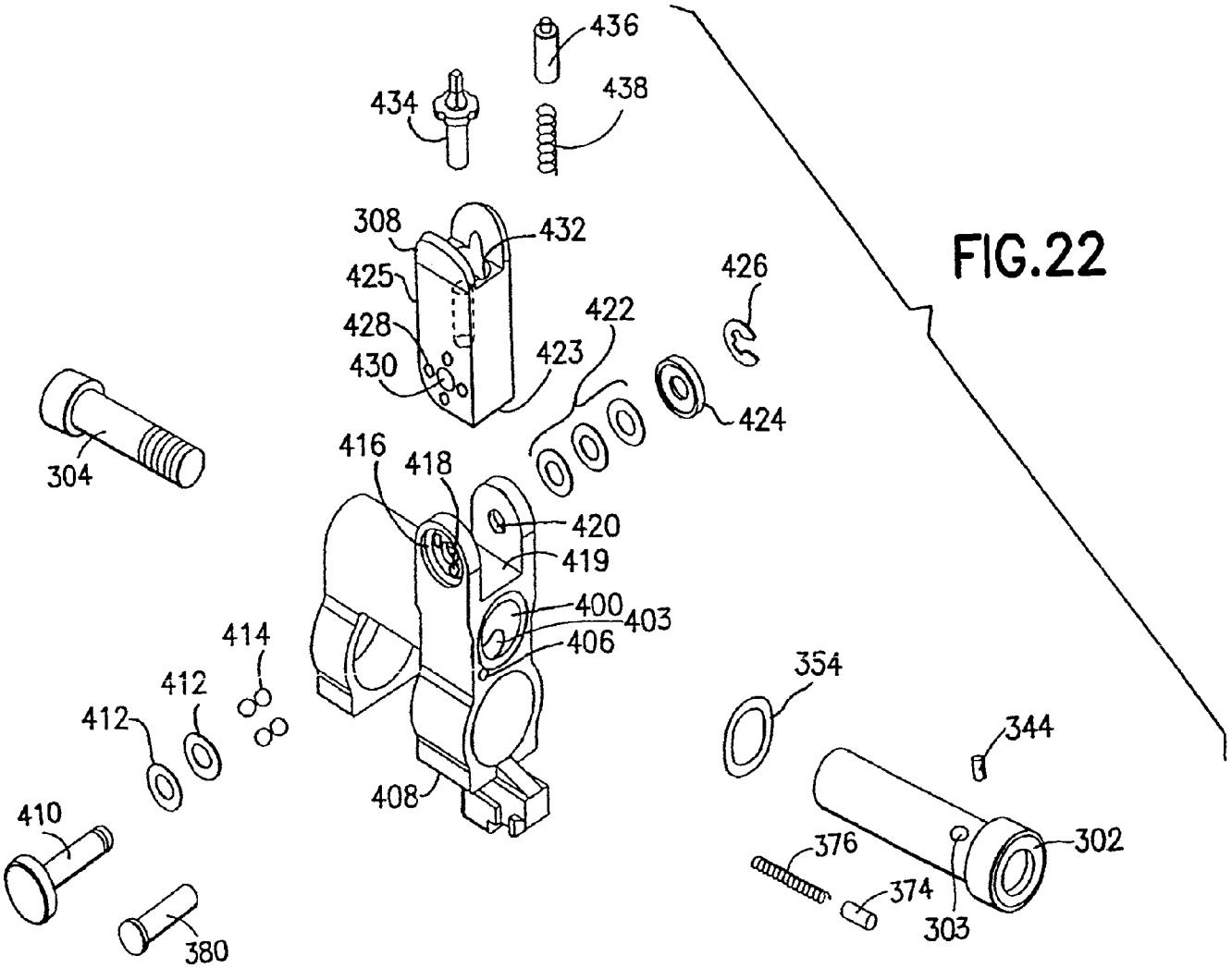
FIG. 22 is an exploded isometric view of a sight and gas piston assembly.

Referring now to FIG. 17, there is shown an exploded isometric view of a sight and gas piston assembly in accordance with another exemplary embodiment. Referring also to FIG. 18, there is shown a side view of a sight 292 and gas piston assembly 294. Referring also to FIG. 19, there is shown a side view of a sight and gas piston assembly. Referring also to FIG. 20, there is shown an exploded side view of a sight and gas piston assembly. Referring also to FIG. 21, there is shown an exploded isometric view of a sight and gas piston assembly. Referring also to FIG. 22, there is shown an exploded isometric view of a sight and gas piston assembly.

Figure 28:
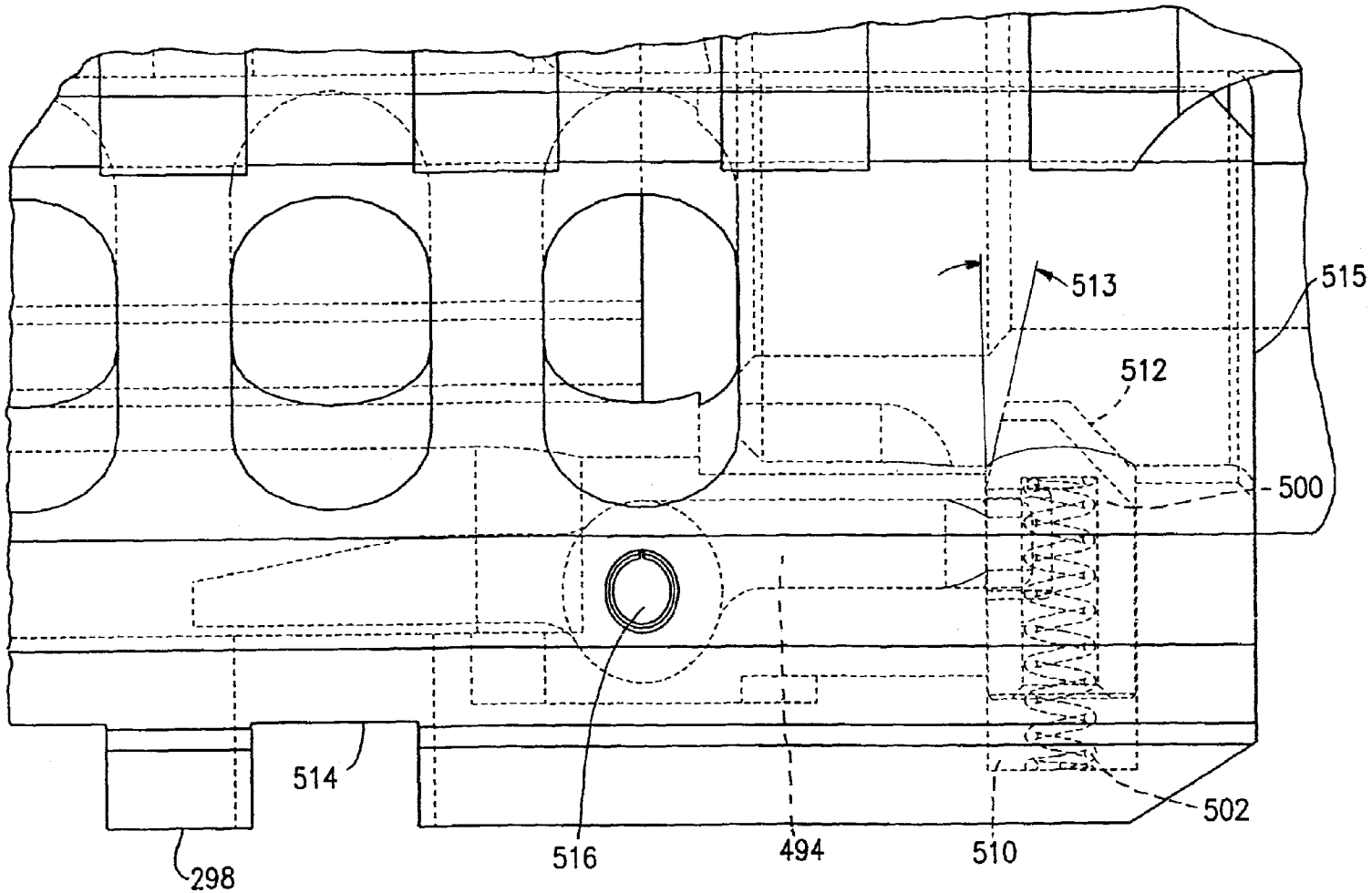
FIG. 28 is a side view of the removable hand guard shown in FIG. 26.

Referring again to FIG. 17 there is shown a representative upper receiver assembly 300, gas piston assembly 294, barrel assembly 300, and lower hand guard assembly 298. In the embodiment shown, the receiver is illustrated as being similar to receiver 34 (described before) for example purposes. In alternate embodiments, the receiver may be of any suitable type. In FIG. 18, the sight assembly 292 is shown with the sight in a raised, deployed position. In FIG. 19, the sight assembly 292 is shown with the sight in a lowered, stowed position. Referring now to FIG. 20, there is shown a side exploded view of the gas piston assembly 294 of the firearm. The gas piston assembly 294 is an indirect gas operating system facilitating automatic or semi-automatic operation in place of a conventional direct gas operating system as will be described below. The gas piston assembly 294 may be adjustable, allowing the operator to vary gas pressure as desired. A suitable example of a gas regulator for a gas piston system is described in U.S. patent application Ser. No. 11/231,063, filed Sep. 19, 2005, and incorporated by reference herein in its entirety. As seen in FIGS. 28-20 the firearm has a gas block 306. The gas block 306 may be fitted, for example to the barrel assembly 300, (though any other suitable barrel may be used) the barrel assembly 300 has a bore (not shown), in fluid communication with a gas passage 403 (see FIG. 22) in the gas block. In the exemplary embodiment, the gas piston assembly 294 has a cylinder sleeve piston 304 and an operating rod 312 is housed within the hand guard of the upper receiver. In the exemplary embodiment the gas piston assembly 294 may be installed and removed from the firearm as a unit as will be described further below. The cylinder sleeve is located in a bore 402 in the gas block. The piston 304 is fitted to cylinder 302. Operating rod 312 is joined to the piston and interfaces with bolt carriage assembly 198 provided within the upper receiver (see FIGS. 7-8). Here, the operating rod has a striking end. The bolt carriage assembly has an impingement surface 216 cooperating with the rod 312 of the operating system. When a cartridge is fired, pressurized gas enters cylinder sleeve 302 in the gas block, displaces piston 304 and causes operating rod 312 to impinge the impingement surface 216 displacing the bolt assembly 198.

Referring again to FIG. 7, the bolt carriage assembly 198 has a bolt carriage frame or carrier and a impinge portion 210. Impinge portion 210 is impinged by operating rod 312 at face or portion 216. Impinge face 216 is located to be substantially coaxial with the operating rod 312. The impinge portion 216 may be suitably shaped (e.g. tapered) to direct loads imparted by rod 312 into the base that engages the impinge portion to the carrier frame. The impinge portion 210 may be press fit, keyed, pinned or otherwise fastened in any desired manner into its corresponding grooves of carrier 198. In alternate embodiments, key ways could be provided within the impinge portion and a corresponding interface on the carrier. In this manner, the bolt assembly may withstand higher impact and operating loads. Referring back to FIGS. 20-22, the cylinder 302 in the gas block has port in fluid communication with the gas block gas passage 403 through an intake or feed disposed on a surface of the cylinder sleeve facing the bore in the gas passage. A piston and rod assembly having a piston 304 and operating rod 312 (housed within hand guard and receiver when mounted to the firearm) cooperate with the cylinder sleeve in the gas block 306. Piston 304 is movably fitted to the cylinder sleeve 302. The operating rod 312 is fixedly joined at its front end, for example by a threaded and/or pinned connection, to piston 304. In the exemplary embodiment, the operating rod may be an assembly with a hollow portion, such as sleeve 310 and a solid end portion, such as rod 312. As may be realized the hollow sleeve, results in a reduction in weight of the operating rod while increasing stiffness. The reduced weight of the operating rod reduces the energy imparted by the operating rod against the bolt carriage, while maintaining equivalent acceleration and hence travel of the bolt carriage when impinged upon the operating rod. In alternate embodiments, other suitable assemblies may be used, for example, where the piston and rod are of two piece or unitary construction. In this embodiment, piston 304 may have a coupling section that couples with sleeve 310, and operating rod 312 has a coupling section 320 that accepts coupling sleeve 310. As seen in FIGS. 20-21, piston 304 and rod 312 each may have a shoulder that mates with sleeve 312. Pins 328 are provided to lock sleeve 310 to piston 304 and rod 312. In alternate embodiments, other engagement techniques could be provided such as threaded coupling. In the embodiment shown, when a cartridge is fired, pressurized gas enters cylinder sleeve 302, displaces piston 304 and causes the operating rod 312 to impinge the impingement surface 216 displacing the bolt carriage assembly. A guide may be provided, for example, to house the operating rod allowing the operating rod to slide freely relative to the receiver. The guide may also have a feature that mates with a mating feature of receiver to correctly position rod relative to the bolt carriage assembly within receiver. The gas piston assembly also includes Spring 314 is provided between the shoulder of rod 312 and stop washer 316 to bias the rod 312 toward the cylinder sleeve 302 where stop washer 316 abuts, the receiver. As may be realized, the operating rod and piston comprises a multi piece operating rod in order to reduce the cost of manufacturing and also reduce weight. For example, sleeve 320 may be made from standard tubing with reduced tolerance. Additionally, components may be heat treated. In the exemplary embodiment the sleeve may connect the piston 304 to end portion of rod 312 with threaded connections, and pins 328 keep the threaded connections from disengaging. A groove 313 may be provided for a snap ring on operating rod 312. After assembly of spring 314 and/or stop 316, the snap ring may be added capturing the spring 314. In this manner, when the piston and operating rod assembly is removed, the assembly, including the spring and retaining components is removed also without further disassembly of the firearm. The spring 314 may also serve as a retention member for stop washer 316 during removal and insertion of the gas piston assembly. For example the end coils of the spring may be positively engaged with the piston and stop washer. For example, the piston and stop washer may each be provided with a channel or groove for interlocking with end coils of the spring. In this embodiment, a snap ring would not be used to retain spring and stop washer on the operating rod.

Figure 24:
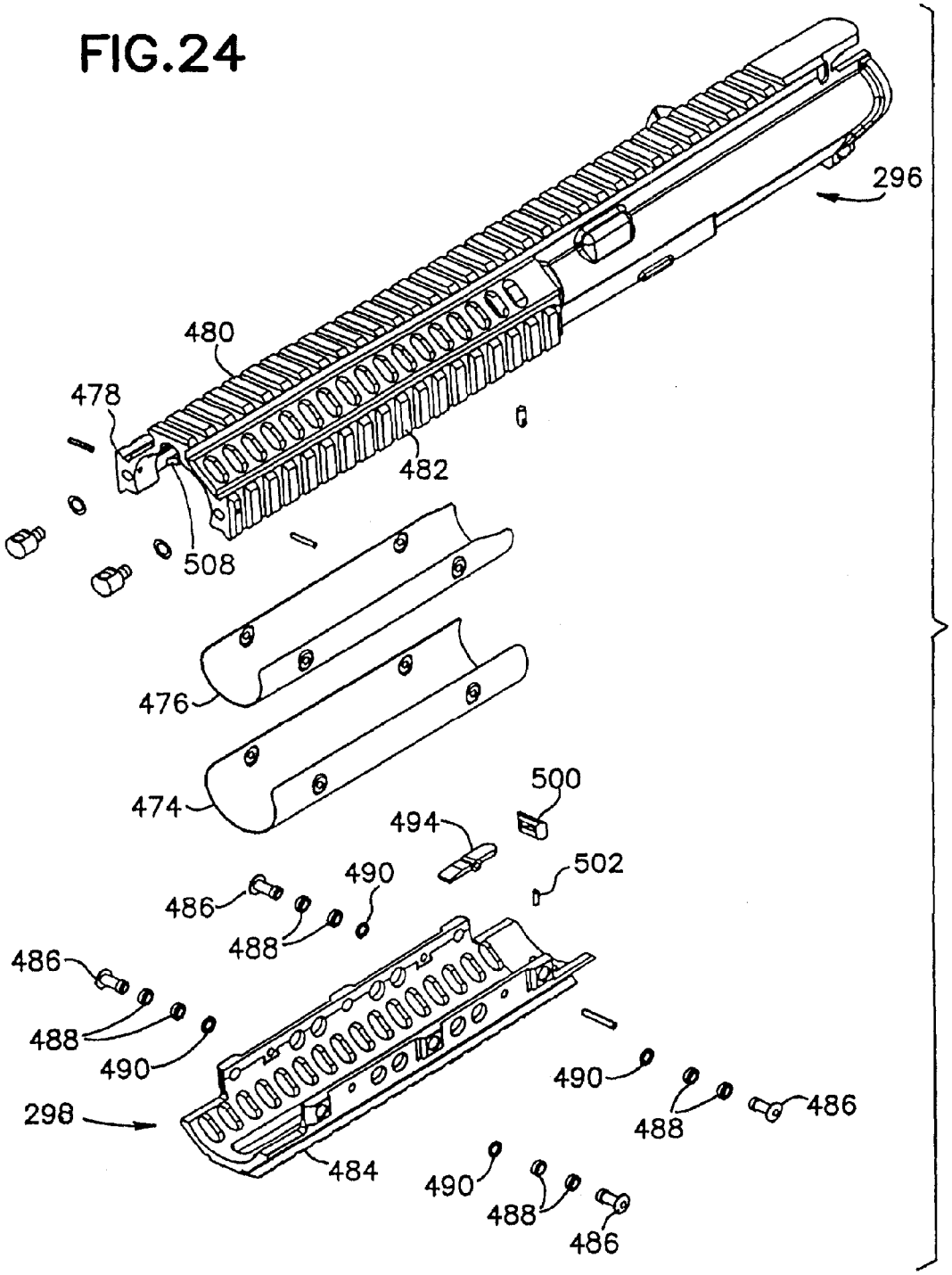
FIG. 24 is an exploded isometric view of an upper receiver assembly.

Referring still to FIGS. 21 and 22, the gas piston assembly 294 incorporates a quick removable cylinder sleeve 302. The sleeve may be removable from the front of gas block 306 and therefore removable from the front of the receiver or rail. This further enables removal of the gas piston assembly from the firearm as a unit. Here, the cylinder and the piston are together removable as an assembly from the firearm without removal of the gas block. In the exemplary embodiment removable cylinder sleeve 302 is maintained captive with takedown pin 356 above cylinder sleeve 302 engaging slot 342. Pin slot 342 in the upper portion of cylinder 302 provides a cam surface for pin 356 to cam gas cylinder sleeve 302 to seal gas cylinder 302 opening to gas port in sight block 306. In this manner, pin 356 engages takedown notch 342 such that pressure reacting on cylinder 302 causes pin 356 to cam cylinder 302 down to the exhaust hole and making a tighter seal. Wave spring 354 is provided under the head of cylinder sleeve 302 to bias cylinder 302 forward, removing play and actuating the cam surface 342 by lock pin 356. In this manner, the cylinder 302 is coupled to the gas block 306 with removable pin 356, where pin 356 provides a camming surface to seal cylinder 302 to a gas port in gas block 306. The take down pin may be held captive, for example, by the spring 362 and detent ball 360, or pin 358, for example. Indexing pin 344 is provided for aligning purposes, aligning cylinder sleeve 302 in proper angular orientation relative to gas block 306. Index pin 344 rests against cam surface 404. Cam surface 404 cams the cylinder sleeve 302 outwards. In the exemplary embodiment cam surface 404 is angled so that rotation of the cylinder sleeve (for example, counterclockwise) bears the pin 344 against can surface 404 forcing cylinder sleeve 302 out of bore 402. Here, the cylinder with index pin 344 in cooperation with camming feature 404 allows cylinder 302 to be rotatably positioned in gas block 306 with index pin 344 engaging camming feature 404 with camming feature 404 providing a camming surface to extract the assembly from the gas block. In the exemplary embodiment, external annular groove(s) 340 are provided on cylinder 302 for cutting carbon buildup in gas block bore 402 housing cylinder sleeve 302 where the gas sleeve is the actual cylinder outer surface. Gas ports 303, 403 (see FIG. 22) may be provided respectively in the cylinder sleeve 302 and the gas block 306, for example gas intake port(s) to the cylinder sleeve. The cylinder sleeve 302 may also have exhaust ports 348. The annular grooves 340 in the outside diameter of cylinder sleeve 302 facilitate cutting gum or carbon that may have impacted on the inside and act as a scrapper and may also be relieved in the back to clear any carbon buildup. Referring still to FIGS. 21 and 22, front sight assembly 292 generally comprises base section 408, front sight post 308 and a spring loaded pivot or detent assembly. Front sight support 308 is mounted to base 408 with sight pivot pin 410. Sight post 434 is threaded into sight support 308 and may be vertically adjustable by rotation and locked with detent 436 spring loaded by spring 438. Front sight 292 comprises a raisable sight with a folding construction allowing a user to position the sight in a raised position shown or to rotate the sight to a lowered stowed position. Spring loaded detent balls lock the sight 308 in the raised, upper or stowed, lowered positions. Holes 428 are provided in sight piece 308. Holes 418 are provided in sight mount 408. Holes 418 house balls 414 where balls 414 are preloaded against sight 308 via Bellville washers 412 backed by Sight pivot pin 410. Pivot pin 410 is retained in bores 420, 430 with washers or Bellville washers 422 and retaining ring 424. Holes 418 and 428 are provided with intentional misalignment between the holes or pockets 428 and holes 418 housing balls 414 to allow the sight to be preloaded against stop surface 419 where the balls 414 do not fully seat in pockets 428. Here, the detent bias' sight step 423, 425 onto flat 419 of sight frame depending on whether the sight is in the raised or lowered position. In alternate embodiments, any suitable stop surfaces or features may be used. Here, sight 308 is provided with bottom locating step 423 preloaded against surface 419 due to the preloaded balls being misaligned with holes 428, resulting in a rotational moment being applied to the sight. Here, the detent bias' and tends to lock the sight forward against a positive stop 419. Here the detent balls being spring loaded creates the bias. In alternate embodiments, more or less balls may be provided or alternate detent mechanisms may be provided to preload the sight against a stop feature. Spring loaded balls 414 are engaged by bellville washers 412 or, for example, by a combination Bellville and flat washer to engage in a locked position providing a detent that engages sight 308 and locks sight 308 in down and up positions. Here, when sight 308 is in the up position, sight 308 is biased forward. Here, surface 423 may be provided with a pad on that bias in position and locks down against so that sight 308 always repeats in the raised position where the raised position is positively located as opposed to relying solely on the positioning of the detent alone where play may be present. Here, the sight is preloaded against a positive stop without any play. Here, four dimples 428 may be provided rotated and misaligned, for example by one degree relative to the poles 418 in the sight 308 when in a desired position, for example, the raised position. This misalignment causes balls 414 to contact a side of holes 428 and opposing sides of holes 418, forcing site 308 forward and against surface 419 where surface 423 is preloaded against the forward portion of surface 419. Similarly, when in the lowered position, misalignment may cause balls 414 to contact a side of holes 428 and opposing sides of holes 418, forcing site 308 rearward and against the rearward portion of surface 419 where surface 425 is preloaded against surface 419. Here, the bias is provided due to the preloaded balls acting on the side of the holes resulting in the sight being maintained in a vertical orientation. In alternate embodiments, more or less balls or holes may be provided in alternate positions. In the embodiment shown, the bias is provided by misalignments of the holes, for example, where the holes 428 in sight 308 are offset by one degree relative to holes 418. In alternate embodiments other offsets or misalignment may be provided to obtain the desired detent. Here, the site 308 has holes 428 rotated counterclockwise relative to holes 418 as shown in FIG. 24 developing a bias onto the forward portion of surface 419 and rotating the sight forward. Similarly, when in the lowered position, the rotation is opposite biasing sight 308 against the rearward portion of surface 419 in the stowed, lowered position.

Figure 23:
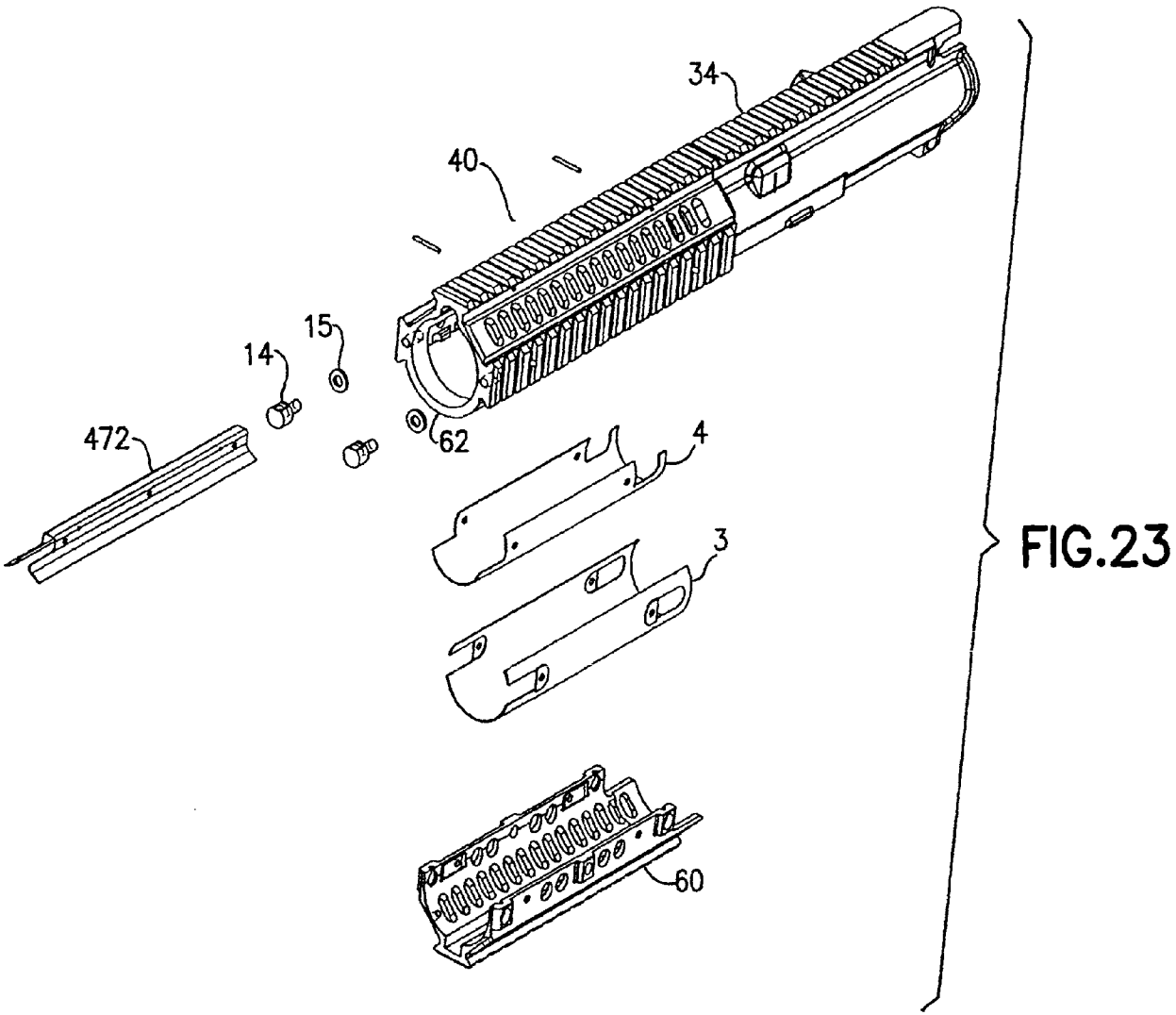
FIG. 23 is an exploded isometric view of an upper receiver assembly.

Referring now to FIG. 23, there is shown an exploded isometric view of the upper receiver 34 having hand guard portion 40. Hand guard 40 has removable lower portion 60 having heat shields 3, 4 to facilitate cooling of the barrel 36 while keeping hand guard 40 at a temperature sufficiently low for an operator. Guide and/or shield 472 may be provided for further cooling or as a guide for piston assembly 294. Heat shield(s) may also be secured to the upper portion 40 using any suitable attachment means such as pins, rivets. The bottom portion 60 may be removably attached to the upper hand guard 40. Support ring 62 is provided at the front of the receiver assembly 34 for strength and attachment purposes. Support or strengthening ring 62 of the upper portion of the hand guard 40 provides a more stable assembly to facilitate manufacture as well as provides a section for the attachment of additional alternate attachments such as by using mounting features 14 to couple attachments, such as a shoulder strap to ring 62. Hand guard 40 may have features such as disclosed in U.S. Pat. Nos. 4,663,875 and 4,536,982, both of which are hereby incorporated by reference herein in their entirety. Hand guard and receiver section may be configured as shown or otherwise to support such rails as a "Piccatiny Rail" configuration as described in Military Standard 1913, which is hereby incorporated by reference herein in its entirety. The rails may be made from any suitable material such as hard coat anodized aluminum as an example. Hand guard 40 may have a forced air cooling system as will be described. For example, radial air grooves may be provided on barrel 36 that extend through the receiver section. The air grooves are part of the forced air cooling system that utilizes the motion of the bolt and bolt carriage assembly to pump cool air along the barrel and through hand guard assembly which houses a radiator element that surrounds a reduced diameter portion of the barrel. Here, air may be forced from the receiver by the bolt assembly, through the barrel retaining nut via grooves into and around the radiator and out cooling holes or slots in the hand guard. In alternate embodiments, the cooling system may be employed on alternate firearm types. Here a one piece monolithic upper receiver is provided having a removable bottom portion 60 of the hand guard where the portion 60 may also have an integral rail, for example, a Piccatiny rail. Here, the bottom portion and rail may be removed to install other accessories, for example, a grenade launcher. Here, the rails on three sides of receiver 34 are fixed at nine o'clock, twelve o'clock and three o'clock with the bottom six o'clock being removable, for example, to allow for mounting of additional accessories. In alternate embodiments. The lower six o'clock rail may be attached by other suitable methods, for example, by latch, rotary latch, push pin, wedge block, front latch or otherwise. For example, a front latch may engage support ring 62.

Figure 25:
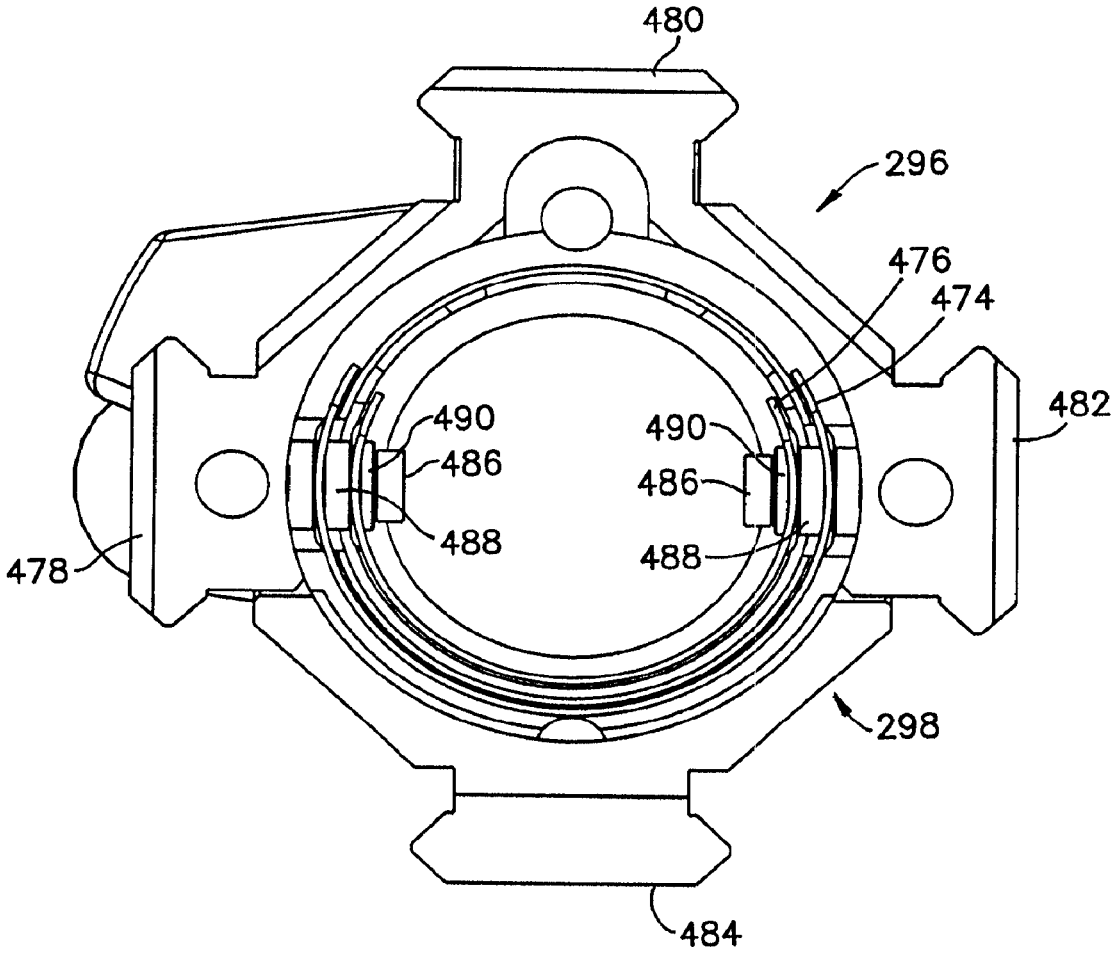
FIG. 25 is an end view of an upper receiver assembly.
Figure 26:
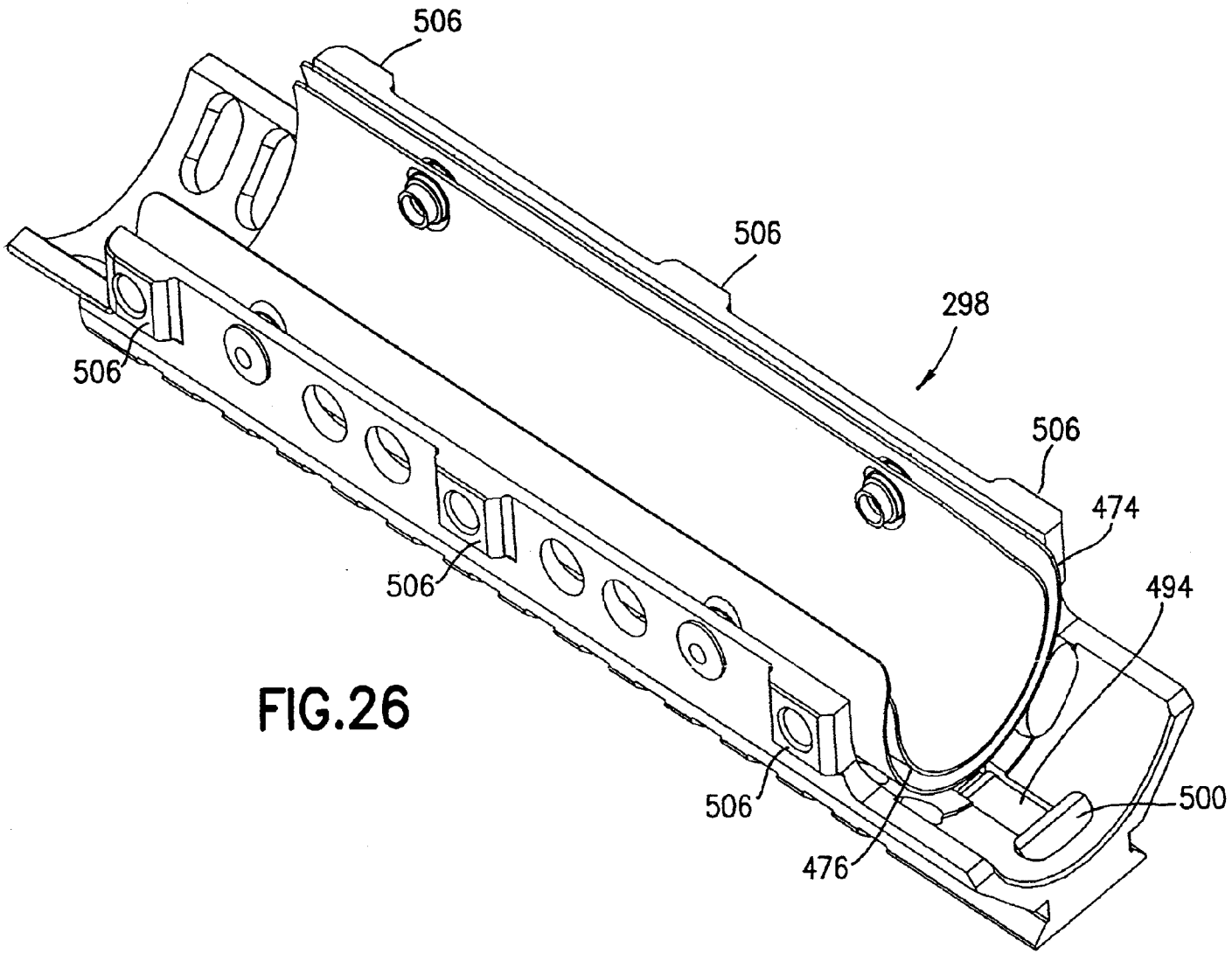
FIG. 26 is an isometric view of a removable hand guard.
Figure 27:
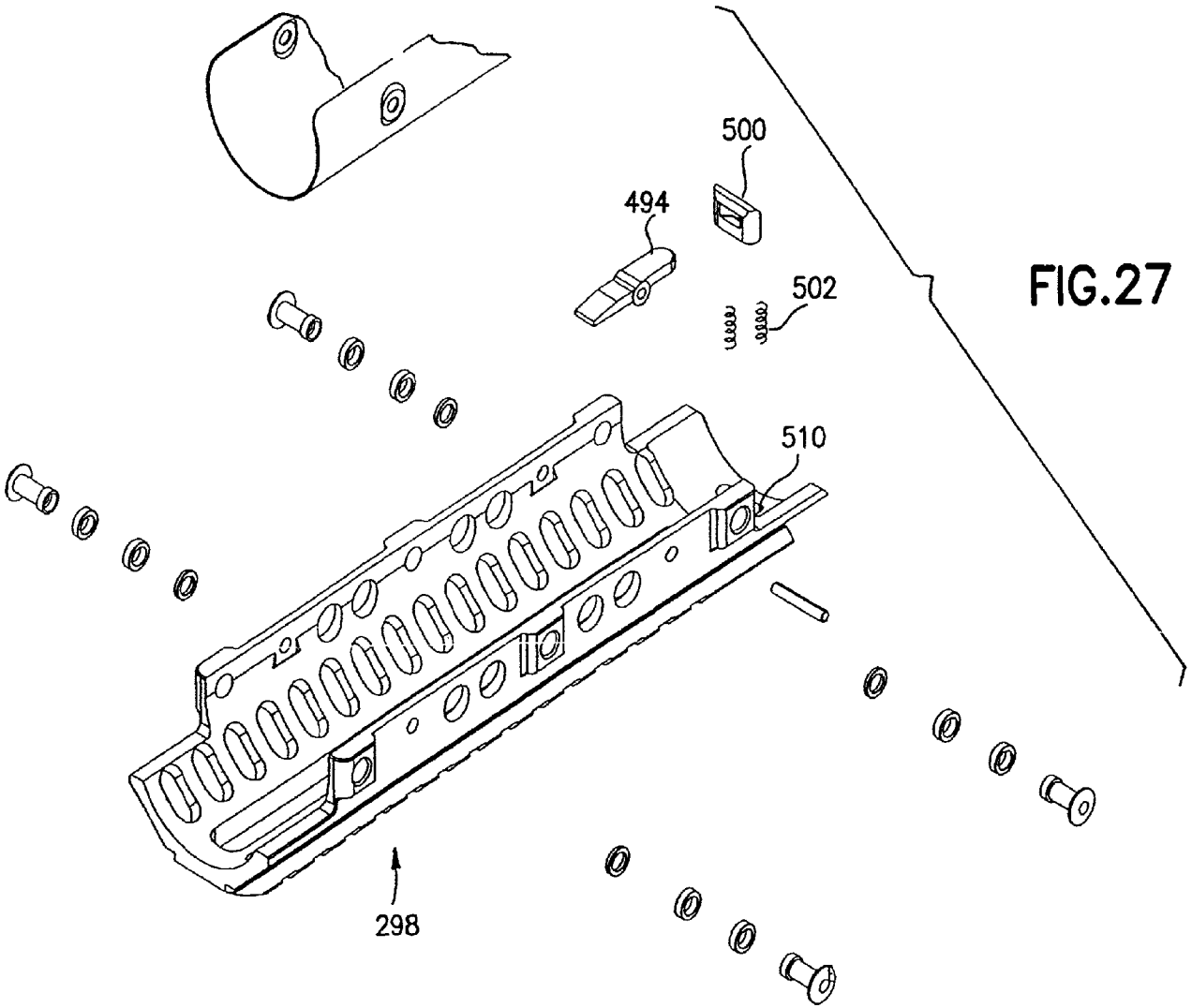
FIG. 27 is an exploded isometric view of the removable hand guard shown in FIG. 28.
Figure 29:
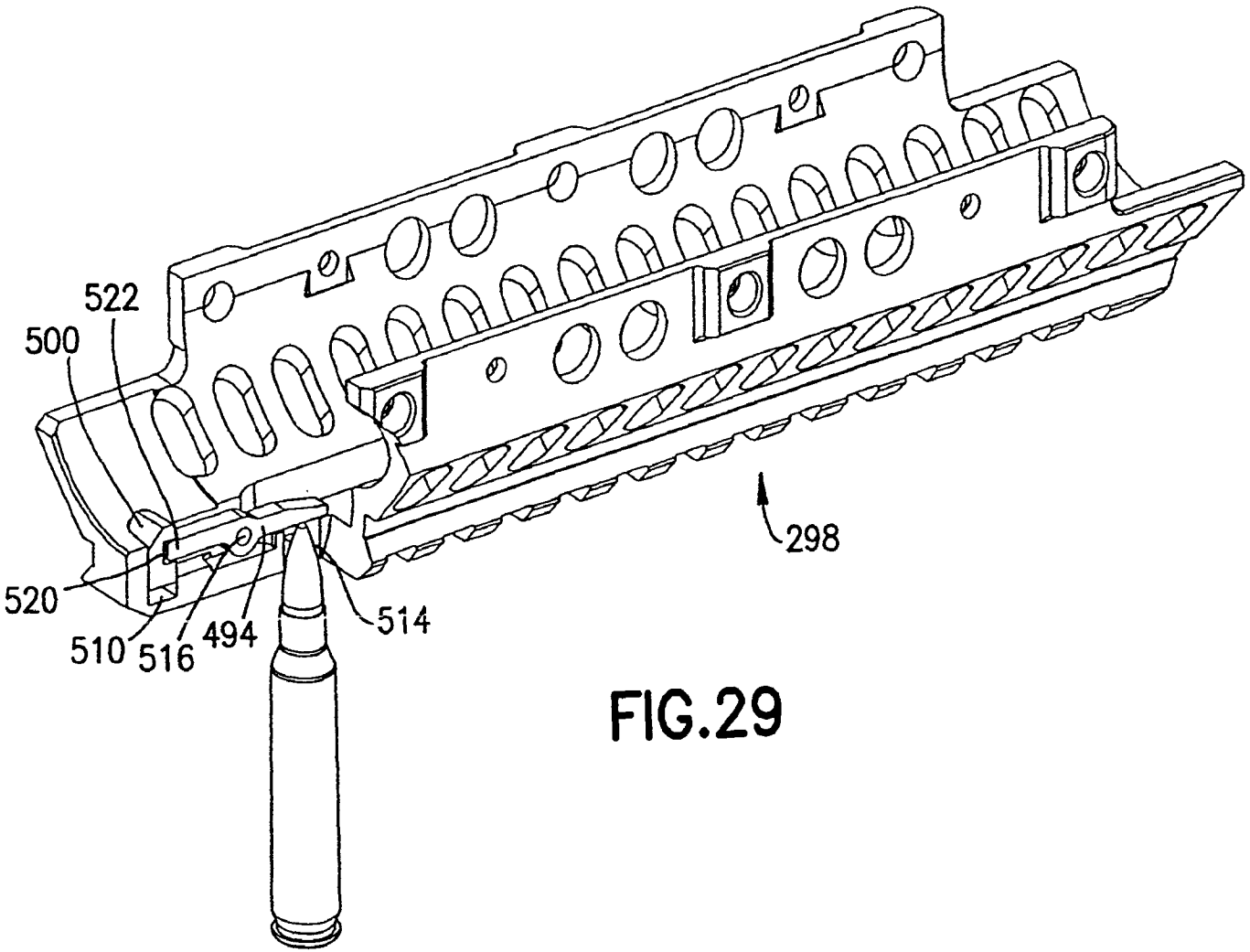
FIG. 29 is an isometric section view of the removable hand guard shown in FIG. 26.

Referring now to FIG. 24, there is shown an exploded isometric view of an upper receiver assembly. Referring also to FIG. 25, there is shown an end view of an upper receiver assembly. Referring also to FIG. 26, there is shown an isometric view of a removable hand guard. Referring also to FIG. 27, there is shown an exploded isometric view of the removable hand guard shown in FIG. 26. Referring also to FIG. 28, there is shown a side view of the removable hand guard shown in FIG. 26. Referring also to FIG. 29, there is shown an isometric section view of the removable hand guard shown in FIG. 26. Upper receiver with hand guard 296 is shown as a monolithic receiver with a support ring and has the same or similar features as receiver 34 with hand guard portion 40. In alternate embodiments, upper receiver 296 may be provided with our without a support ring. Upper receiver 296 is provided with rails on three sides fixed at the nine o'clock 478, twelve o'clock 480 and three o'clock 482 positions with the bottom six o'clock rail 484 being removable as part of lower portion 298, for example, to allow for mounting of additional accessories. Lower portion 298 has features the same or similar as portion 60. As shown in FIG. 25, heat shields 476, 474 may be provided with attachment rivets 480, shield spacers 488 and backing washer 490. In alternate embodiments, other suitable shields or attachment methods may be provided. Lower hand guard section 298 is provided with a spring loaded latch or locking member 500 that fits into and locks up into a recess on the inside of the underneath of the one piece upper receiver 296, for example, into a groove. Here, locking member 500 is spring loaded, with the spring loading biasing the locking member to the locked position with the locking member engaging a recess in the receiver with a spring loaded engaging force. Referring also to FIG. 29, a latch actuation lever 494 is pivotally mounted on pin 516 to lower portion 298. Here, the quick release lock has lever 494 pivotally mounted to the removable mounting rail for actuating the locking member 500. Actuation lever 494 has tongue portion 522 engaging slot 520 of latch member 500. Latch member 500 is spring loaded upward with springs 502 and engaged in pocket 510 of lower portion 298. Latch actuator lever 494 is provided accessible from underneath, for example, with the point of a suitable and readily available object, such as a cartridge, through an opening 514 in the lower portion 298. Here, the quick release lock is included in the removable mounting rail, and the removable mounting rail has an opening for accessing and operating the lever. As can be seen in FIG. 29, the single action of pushing the lever 494 up effects lowering and releasing latch 500 from a corresponding slot 512 (see FIG. 28) in receiver 296 thereby simultaneously unlocking the removable hand guard from the receiver so that the hand guard is free to move or be slid and lowered from the receiver. Here, a single latch 500 is provided cooperating with a lock tongue 506 and groove 508 that slide together. Lock tongue 506 and groove 508 cooperate with latch 500 to accept and retain lower portion 298 to receiver 296. Here, the six o'clock rail 298 goes up into the groove 508 and slides to a retained position and goes back where the detent 500 snaps into a groove 512 on the upper receiver 296 locking lower portion 298 in place. Here, the locking member 500 moves automatically to and snaps into the locked position when the removable mounting rail is located in the installed position. Detent 500 and groove 512 have a corresponding engagement angle 513 providing a preloading and biasing force urging the hand guard against the receiver. Here, locking member 500 has an engagement portion protruding from the removable mounting rail and engaging a recess in the receiver at the interface of angle 513. The shallow angle 513 in combination with spring 512 provide a biasing force at interface 515 between the hand guard and the receiver. Here, with angle 513, detent 500 acts as a wedge urging the hand guard rearward. Here, a removable hand guard is provided and removably attached to the receiver by an attachment that stably holds the removable hand guard to the receiver, where the attachment is arranged for allowing detachment and removal of the removable hand guard from the receiver without removal of fasteners, where the integral hand guard is an upper hand guard located over the barrel, where the removable hand guard is a lower hand guard that mates with the upper hand guard to enclose the barrel and where the removable hand guard is selectable from a number of different interchangeable removable hand guards, each having a different predetermined characteristic, for example, mounting rails or accessory devices.

Figure 30:
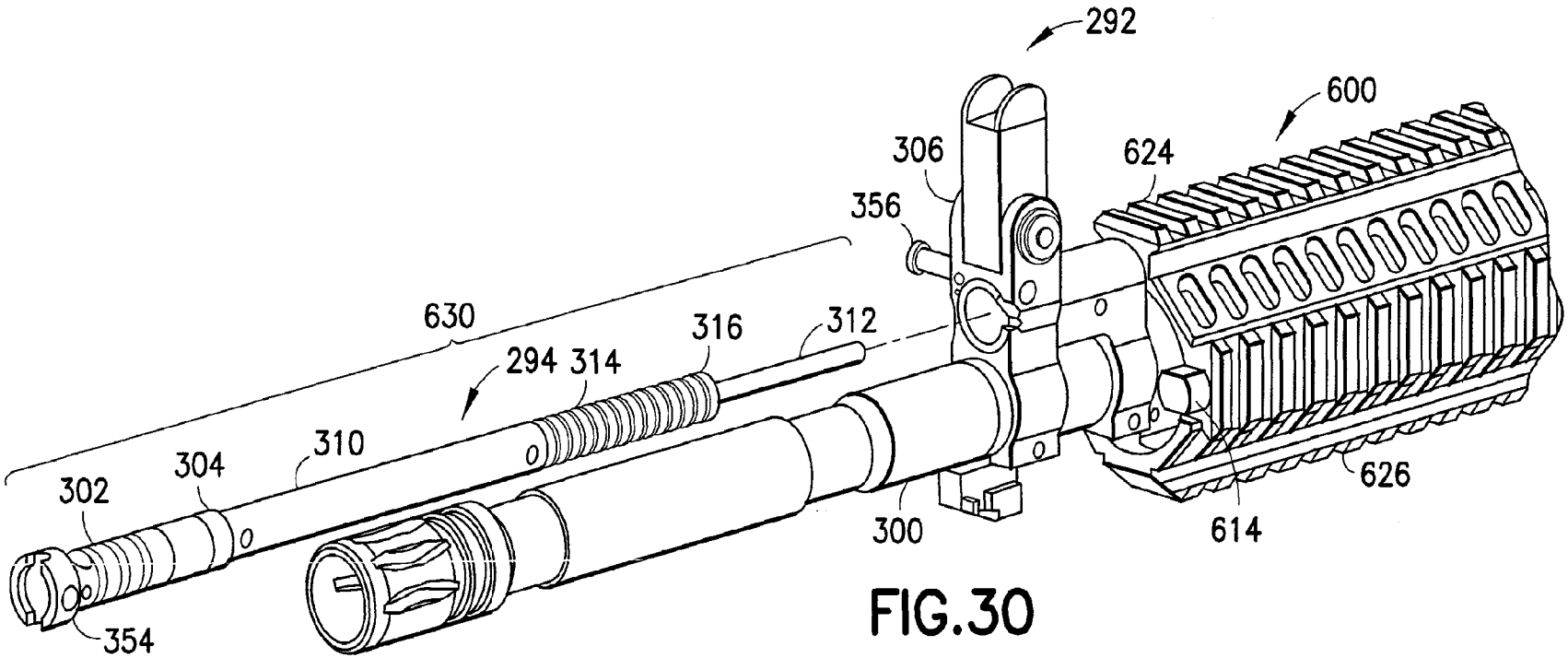
FIG. 30 is an isometric view of a sight and gas piston assembly.

Referring now to FIG. 30, there is shown an isometric view of upper receiver assembly 600, indirect gas operating system 294, and barrel assembly 300. In the alternate embodiment of receiver assembly 600 shown, upper hand guard portion 624 and lower hand guard portion 626 are integral to receiver section 600. Receiver section 600 has lightening and ventilation holes of sufficient size to prevent, for example, fingers from entering the holes while being sufficient to enable convection and provide air flow there through. The system has a gas block 306 having a cylinder 302 therein. The gas block 306 is fitted to barrel assembly 300 where barrel assembly 300 has a bore with the cylinder being in fluid communication with the bore through a port. In the embodiment shown, gas piston assembly 294 has a piston 304 and a striking rod 312 housed within the hand guard 624 of the upper receiver 600. The piston 304 is fitted to cylinder 302. As previously described, operating rod 312 interfaces with bolt carriage assembly 198 provided within the upper receiver where bolt carrier assembly 198 is provided with skids 218, 220 to support and stabilize carrier assembly 198 on a lower surface of the receiver assembly (see FIGS. 7 and 8). In the embodiment shown, cylinder 302 and piston assembly 294 are together removable as an assembly 630 from the firearm without removal of gas block 306, and without disassembly of the firearm as shown in FIG. 30. Here, assembly 630 is removable from the bore of block 306 where assembly 630 may include cylinder 302, piston 304, spacer 310 and operating rod 312 with spring 314 and ring 316. In the embodiment shown, spacer 310 comprises a portion of tubing having threaded features on each end. Thus, spacer 310 has a reduced mass as compared to a solid spacer. As will be described below, rod 312 and ring 316 have features allowing them to be retained as an assembly with spring 314. Here, the components from cylinder 302 through operating rod 312 and including spring 314 and ring 316 are removable and insertable from the firearm as an integral assembly. As previously described, removable gas piston sleeve 302 is maintained captive with takedown pin 356 above piston sleeve 302 by engaging slot 342 (see also FIGS. 36, 37). Pin slot 342 in the upper portion of cylinder 302 provides a cam surface for pin 356 to cam gas cylinder 302 and to seal gas cylinder 302 opening to a gas port in sight block 306. This bias is provided where wave washer spring 354 (see FIG. 21) bias' cylinder 302 against pin 356 and also, when firing, gas pressure inside cylinder 302 urges cylinder 302 against pin 356 causing camming of cylinder 302 against the bore 402 of block 306. Here, wave washer/spring 354 applies bias on cylinder sleeve 302 and preloads cylinder sleeve 302 against takedown pin 356 to eliminate impact and motion of cylinder sleeve 302 on piston stroke.

Figure 31:
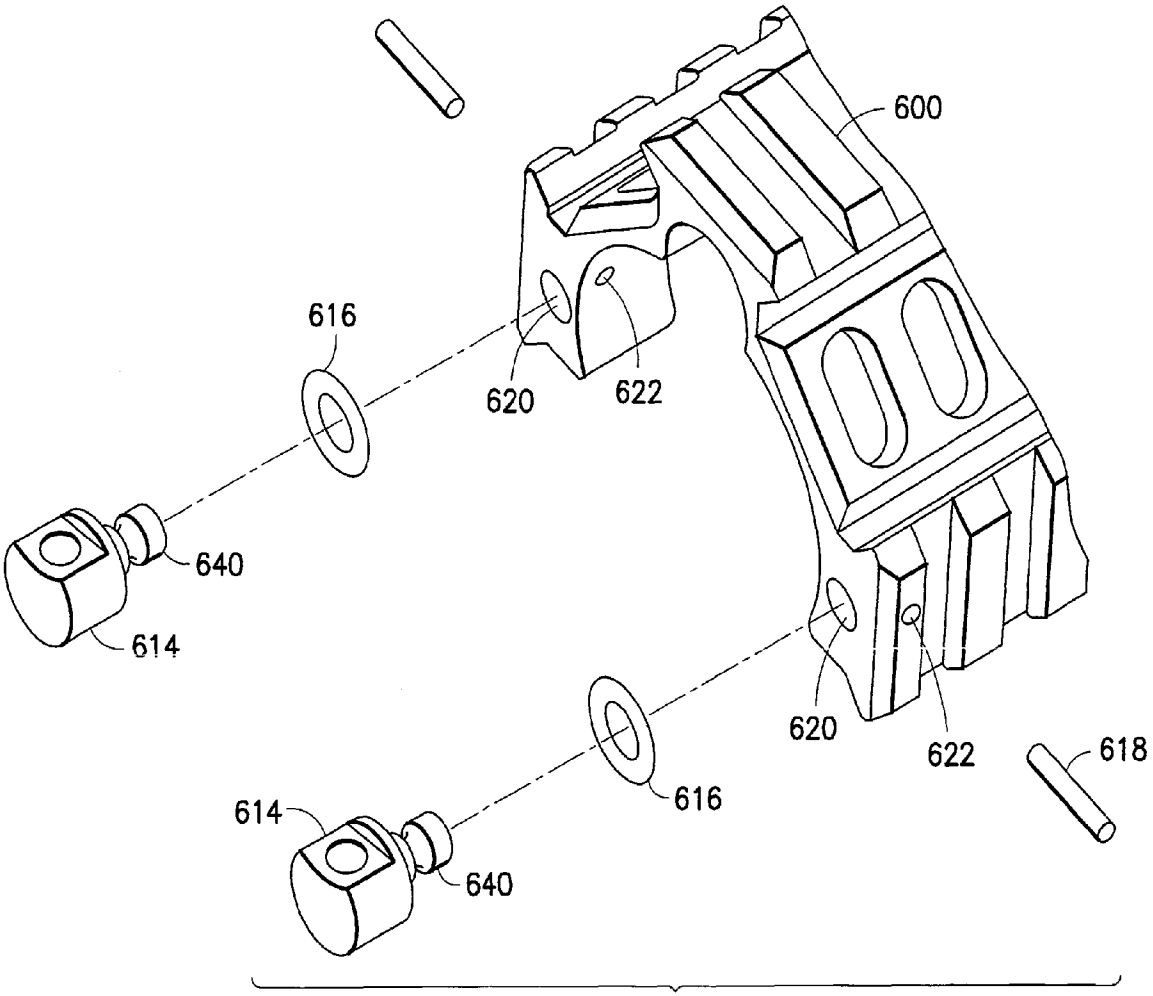
FIG. 31 is an exploded isometric view of the upper receiver with hand guard section of the firearm shown in FIG. 30.
Figure 32:
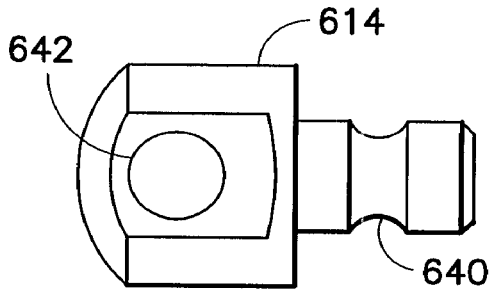
FIG. 32 is a top view of a mounting feature of the firearm shown in FIG. 30.
Figure 33:
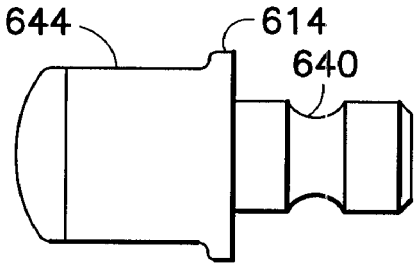
FIG. 33 is a side view of a mounting feature of the firearm shown in FIG. 30.

Referring now to FIG. 31, there is shown an exploded isometric view of the upper receiver with hand guard section of the firearm shown in FIG. 30. In the embodiment shown, upper receiver 600 has rotating attachment or mounting features 614 mounted in bore 620. Bore 620 may be provided as a hole into the front of hand guard 600, for example, where bore 620 does not interfere with mounting access on the rails of receiver 600. Mounting feature(s) 614 may be provided to mount peripheral devices, such as slings or otherwise to the firearm. Wave washers 616 are shown to preload and bias features 614 within receiver 600, for example, so they do not rattle. The preload is accomplished by biasing annular cut 640 against pin 618. Pins 618 are provided and pressed into holes 622 of receiver 600 to capture features 614 on a portion of radial groove 640. In the event holes 622 are not through holes, removal of pins 618 may require drilling. Referring also to FIG. 32, there is shown a top view of a mounting feature 614 of the firearm shown in FIG. 30. Referring also to FIG. 33, there is shown a side view of a mounting feature 614 of the firearm shown in FIG. 30. Radial grooves 640 are provided, turned into feature 614 such that feature 614 is free to rotate within bore 620 while still being captured with pin 618 interfacing with groove 640. In this manner, feature 614 is able to rotate in bore 620 without loosening or backing out.

Mounting hole 642 is provided with flats 644 to provide a mounting point for peripheral devices.

Figure 34:
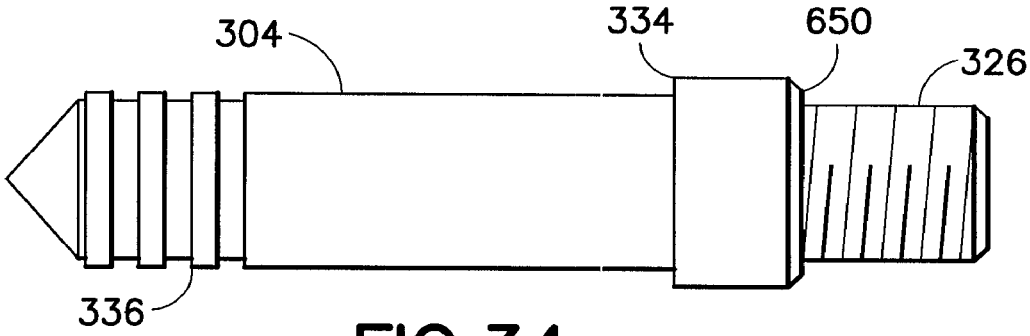
FIG. 34 is a side view of a piston.

Referring now to FIG. 34, there is shown a side view of a piston 304. Piston 304 has annular grooves 336 on the exterior of piston 304 that may form a labyrinth seal for trapping exhaust blow by through cylinder 302 and to minimize carbon build up. Although grooves 336 are shown radially cut, in alternate embodiments, grooves 336 may have any suitable shape, for example, grooves 336 may be helically cut. Here, slots or grooves 336 are adapted to remove carbon build up during operation. In alternate embodiments, grooves 336 may be provided with rings, with the rings adapted to remove carbon build up during operation. As previously discussed, piston 304 is movably fitted to the cylinder 302 and has shoulder 334 that acts as a stop. Threaded connection 326 is provided to connect piston 304 to rod 312 via intermediate sleeve 310. In alternate embodiments, other suitable assemblies may be used, for example, where the piston and rod are of two piece or unitary construction. In this embodiment, piston 304 has a threaded section 326 that accepts threaded sleeve 310 and operating rod 312 has a threaded section 320 that accepts threaded sleeve 310. Piston 304 has a shoulder 650 mating with sleeve 310. Pins 328 are provided to lock sleeve 310 to piston 304. A cone shaped nose is provided on piston 304.

Figure 35:
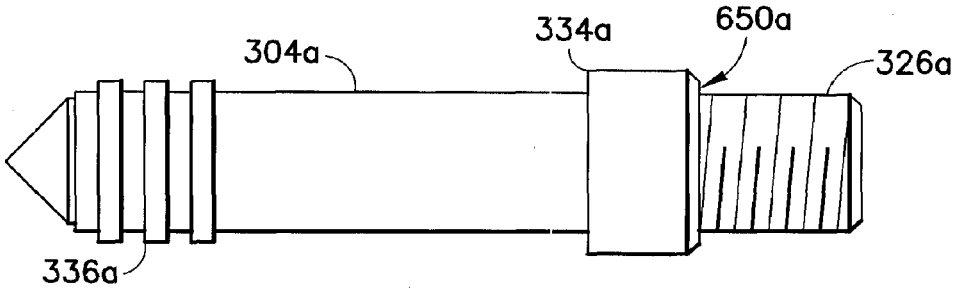
FIG. 35 is a side view of an alternate embodiment piston.

Referring now to FIG. 35, there is shown a side view of an alternate embodiment piston 304*a*. Piston 304*a* has rings 336*a* set in annular grooves on the exterior of piston 304*a* that may form a seal for trapping particles and exhaust blow by through cylinder 302 and to minimize carbon build up. Although rings 336*a* are shown radially, in alternate embodiments, rings 336*a* may have any suitable shape. Similar to piston 304, piston 304*a* is movably fitted to the cylinder 302 and has shoulder 334*a* that acts as a stop. Threaded connection 326*a* is provided to connect piston 304*a* to rod 312 via intermediate sleeve 310. In alternate embodiments, other suitable assemblies may be used, for example, where the piston and rod are of two piece or unitary construction. In this embodiment, piston 304*a* has a threaded section 326*a* that accepts threaded sleeve 310 and operating rod 312 has a threaded section 320 that accepts threaded sleeve 310. Piston 304*a* has a shoulder 650*a* mating with sleeve 310. Pins 328 are provided to lock sleeve 310 to piston 304*a*. A cone shaped nose is provided on piston 304*a*.

Figure 36:
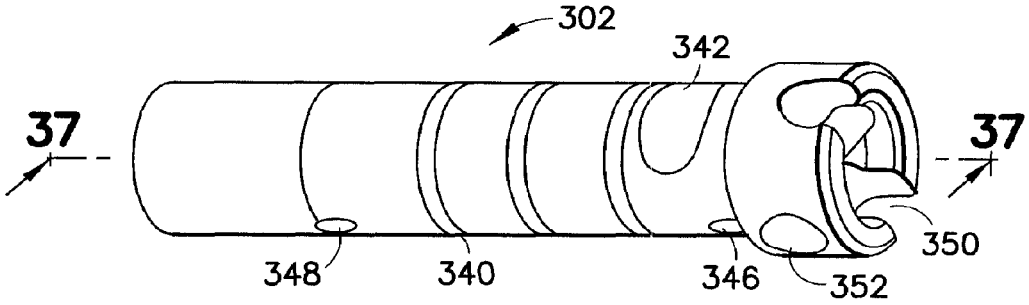
FIG. 36 is an isometric view of a cylinder.
Figure 37:
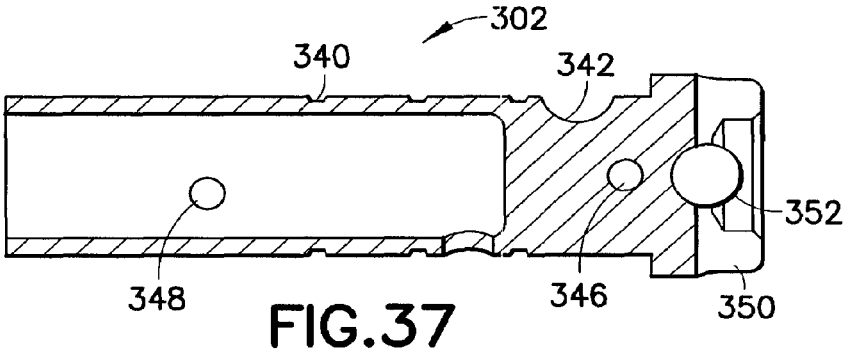
FIG. 37 is a section view of a cylinder.

Referring now to FIG. 36, there is shown an isometric view of cylinder 302. Referring also to FIG. 37, there is shown a section view of cylinder 302. Cylinder 302 has retention feature 342 cut as a half moon slot transverse the bore for a retention pin 356 through gas block 306. As previously described, pin 356 is captured and acts to retain and position cylinder 302 in gas block 306. In the embodiment shown, annular grooves 340 are provided on the exterior of cylinder 302 and form a labyrinth seal to block 306 for trapping exhaust blow by and thus minimizing carbon build up. Additionally, grooves 340 facilitate removal of carbon. Although grooves 340 are shown radially cut, in alternate embodiments, grooves 340 may have any suitable shape, for example, grooves 340 may be helically cut. In the embodiment shown, grooves 340 may be located on both sides of gas port or exhaust port 346, 348 on cylinder sleeve 302. The annular grooves 340 in the outside diameter of cylinder 302 facilitate cutting gum or carbon that may have impacted on the inside and act as a scraper and may also be relieved in the back to clear any carbon buildup. Here, gas piston sleeve 302 is the gas cylinder.

Figure 38:
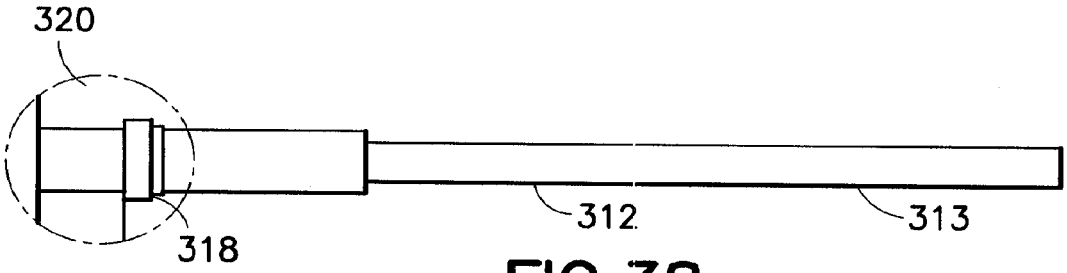
FIG. 38 is a side view of an operating rod.
Figure 39:
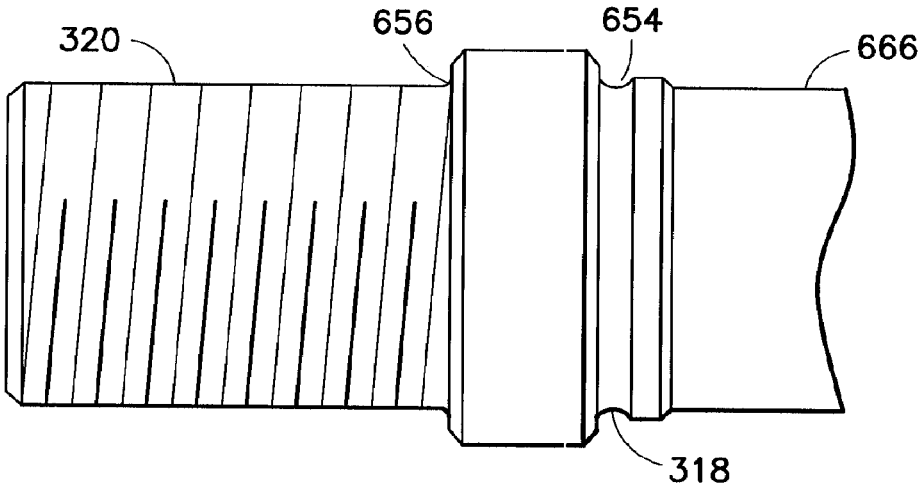
FIG. 39 is a side view of the operating rod shown in FIG. 38.

Referring now to FIG. 38, there is shown a side view of operating rod 312. Referring also to FIG. 39, there is shown a side view of operating rod 312. Operating rod interfaces with hollow portion 310 (hollow tube) provided for reducing mass and loading on bolt carriage key. Rod 312 has a threaded section 320 that accepts threaded sleeve 310. Rod 312 has a shoulder 656 mating with sleeve 310. Pins 328 are provided to lock sleeve 310 to rod 312. Rod 312 further has an annular or helical conformal groove 654 adapted to accept an end turn of spring 314. In this manner, when rod 312 is extracted from the firearm, spring 314 is retained on rod 312. Diameter 666 is provided to allow suitable clearance between rod 312 and spring 314 so as not to impede motion of spring 314.

Figure 40:
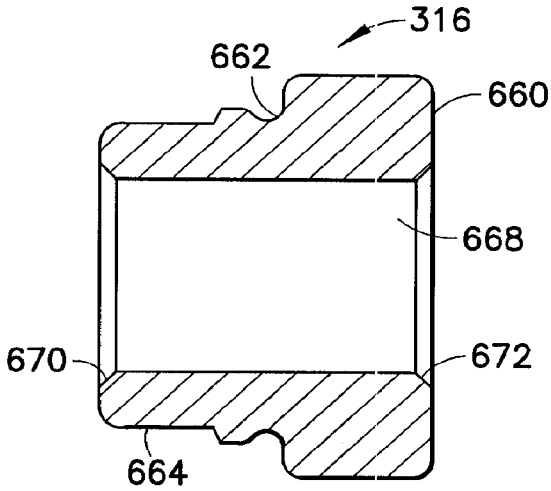
FIG. 40 is a section view of a spring backstop ring.

Referring now to FIG. 40, there is shown a section view of spring backstop ring 316. Spring backstop ring has face 660 seating on receiver 600 when the piston assembly is installed. Spring backstop ring 316 is slideable on operating rod 312 but is held in position by being anchored to spring 314 with annular or helical groove 662 in a manner similar to rod 312. Here, a spring wire turn engages the helical groove 662 in backstop ring 316 an a similar manner as where the front spring 314 has a wire turn engaged in a helical conformal groove 654 of operating rod 312. In this manner, when rod 312 is extracted from the firearm, spring 314 is retained on rod 312 and ring 316 retained on spring 314. Diameter 664 is provided to allow suitable clearance between ring 316 and spring 314 so as not to impede motion of spring 314.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An indirect gas operating system for a semi-automatic or automatic rifle, the indirect gas operating system comprising:

a gas block secured to the rifle;

a barrel secured to the rifle;

a bolt carrier slidably received within a receiver of the rifle;

a means for moving the bolt carrier within the receiver using gases discharged into a bore of the barrel of the rifle, wherein the means for moving is removably secured to the gas block such that the means for moving can be removed from the rifle through a forward end of the gas block without removing the gas block from the rifle; and an externally threaded barrel nut for securing the barrel to the receiver.

2. The indirect gas operating system as in claim 1, wherein the receiver further comprises an integral hand guard portion and a removable hand guard portion.

3. The indirect gas operating system as in claim 2, wherein the removable hand guard portion when removed provides access to the barrel nut that secures the barrel to the receiver.

4. The indirect gas operating system as in claim 3, wherein the receiver is an upper receiver and the upper receiver is removably secured to a lower receiver of rifle.

5. The indirect gas operating system as in claim 4, wherein the barrel and barrel nut can be removed from the rifle without removing the means for moving the bolt carrier within the receiver of the rifle.

6. The indirect gas operating system as in claim 5, wherein the external thread of the barrel nut interfacing with threads of the receiver when the barrel nut secures the barrel to the receiver.

7. The indirect gas operating system as in claim 6, wherein a barrel extension is located between the barrel and the barrel nut.

8. A rifle having the indirect gas operating system of claim 7.

9. The indirect gas operating system as in claim 1, wherein the means for moving further comprises a means for varying a gas pressure provided from the bore of the barrel towards the bolt carrier.

10. The indirect gas operating system as in claim 9, wherein the receiver further comprises an integral hand guard portion and a removable hand guard portion.

11. A rifle having the indirect gas operating system of claim 10.

12. A rifle having the indirect gas operating system of claim 1.

13. A semi-automatic or automatic rifle having an indirect gas operating system, comprising:

a gas block fluid coupled to a bore of a barrel of the rifle;

a bolt carrier slidably received within a receiver of the rifle;

a sleeve removably secured to a forward end of the gas block of the rifle;

a piston slidably received within the gas block, wherein the gas block and the sleeve fluidly couple the piston to the bore of the rifle;

wherein an increase in pressure in the bore of the rifle causes the piston to move away from the sleeve;

wherein the sleeve and the piston are each capable of being removed from the rifle through the forward end of the gas block; and wherein the receiver has an integral hand guard portion and a removable hand guard portion and wherein the removable hand guard portion when removed from the receiver provides access to a barrel nut that secures the barrel to the receiver.

14. The semi-automatic or automatic rifle as in claim 13, wherein the receiver is an upper receiver and the upper receiver is removably secured to a lower receiver of rifle.

15. The semi-automatic or automatic rifle as in claim 14, wherein the barrel and barrel nut can be removed from the receiver without removing sleeve and piston from the receiver of the rifle and wherein the barrel nut is externally threaded for interfacing with threads of the receiver and wherein a barrel extension is located between the barrel and the barrel nut.

16. A method of fluidly coupling a barrel of a semi-automatic or automatic rifle to a bolt carrier of the rifle, comprising:

providing a means for moving a bolt carrier within a receiver of the rifle using gases discharged into a bore of a barrel of the rifle, wherein the means for moving is removably secured to a gas block of the rifle such that the means for moving can be removed from the rifle through a forward end of the gas block without removing the gas block from the rifle; and removably securing a removable hand guard portion to an integral hand guard portion of the receiver of the rifle, wherein the removable hand guard when removed provides access to a barrel nut that secures the barrel to the rifle.

17. The method as in claim 16, wherein the barrel and barrel nut can be removed from the rifle without removing the means for moving the bolt carrier within the receiver of the rifle.

18. The method as in claim 17, wherein the barrel nut is externally threaded for interfacing with threads of the receiver.

19. The method as in claim 18, wherein a barrel extension is located between the barrel and the barrel nut.

* * * * *